US005527239A

United States Patent [19]

Abbondanza

[11] Patent Number: 5,527,239

[45] Date of Patent: Jun. 18, 1996

[54] PULSE RATE CONTROLLED EXERCISE SYSTEM

[76] Inventor: James M. Abbondanza, 2493 Weston Ave., Niagara Falls, N.Y. 14305

[21] Appl. No.: 13,643

[22] Filed: Feb. 4, 1993

[51] Int. Cl.[6] ..... A61B 5/04

[52] U.S. Cl. ..... 482/8; 482/1; 482/2; 482/3; 482/4; 482/9; 482/901; 482/902

[58] Field of Search ..... 482/1–9, 54, 62, 482/901, 902; 364/413.01; 128/696, 697, 710

[56] References Cited

U.S. PATENT DOCUMENTS

| | | | |
|---|---|---|---|
| 3,395,698 | 8/1968 | Morehouse . | |
| 4,244,021 | 1/1981 | Chiles, III | 482/5 X |
| 4,278,095 | 7/1981 | Lapeyre | 482/7 X |
| 4,358,105 | 11/1982 | Sweeney, Jr. . | |
| 4,436,097 | 3/1984 | Cunningham | 482/62 X |
| 4,613,129 | 9/1986 | Schroeder et al. . | |
| 4,643,418 | 2/1987 | Bart . | |
| 4,687,195 | 8/1987 | Potts . | |
| 4,708,337 | 11/1987 | Shyu . | |
| 4,736,322 | 4/1988 | Clifford . | |
| 4,763,284 | 8/1988 | Carlin | 482/84 X |
| 4,800,310 | 2/1989 | Nakao et al. . | |
| 4,805,631 | 2/1989 | Maroc, II | 482/8 X |
| 4,807,639 | 2/1989 | Shimizu et al. | 128/706 X |
| 4,828,257 | 5/1989 | Dyer et al. | 482/5 |
| 4,842,266 | 6/1989 | Sweeney, Sr. et al. . | |
| 4,848,737 | 7/1989 | Ehrenfield et al. . | |
| 4,911,427 | 3/1990 | Matsumoto et al. . | |
| 4,934,692 | 6/1990 | Owens . | |
| 4,938,474 | 7/1990 | Sweeney et al. . | |
| 4,976,424 | 12/1990 | Sargeant et al. . | |
| 4,998,725 | 3/1991 | Watterson et al. . | |
| 5,001,632 | 3/1991 | Hall-Tipping | 482/902 X |
| 5,020,794 | 6/1991 | Englehardt et al. | 482/902 X |
| 5,037,089 | 8/1991 | Spagnuolo et al. . | |
| 5,063,928 | 11/1991 | Grevis et al. . | |
| 5,067,710 | 11/1991 | Watterson et al. . | |
| 5,104,120 | 4/1992 | Watterson et al. . | |
| 5,125,412 | 6/1992 | Thornton | 128/710 X |
| 5,135,447 | 8/1992 | Robards, Jr. et al. . | |
| 5,207,621 | 5/1993 | Kock et al. | 482/53 |
| 5,207,623 | 5/1993 | Tkatchouk et al. | 482/61 |
| 5,213,555 | 5/1993 | Hood et al. | 482/902 X |
| 5,230,672 | 7/1993 | Brown et al. | 482/902 X |
| 5,230,673 | 7/1993 | Maeyamo et al. | 482/902 X |
| 5,267,568 | 12/1993 | Takara | 128/704 X |

FOREIGN PATENT DOCUMENTS 0199442 10/1986 European Pat. Off. .

OTHER PUBLICATIONS

Panther By Stairobic sales brochure, Feb. 5, 1993.
Sears & Roebuck Catalog product description.
Videocycle advertisement.
Mindscope Advertisement.
Hammer/Schlammer Catalog: Interactive Wireless Video Exercise Cycle.
Proform Fitness Products: Video Track Advertisement, Dec. 1991.

*Primary Examiner*—Richard J. Apley
*Assistant Examiner*—Glenn E. Richman
*Attorney, Agent, or Firm*—Banner & Allegretti, Ltd.

[57] ABSTRACT

A pulse controlled exercise system is disclosed which incorporates an exercise device, a monitor capable of displaying images formed from television signals, a pulse rate sensor for sensing the pulse rate of a user of the pulse controlled exercise system, and a controller. The controller is coupled to the pulse rate sensor, to the exercise device, and to the monitor. The controller is used to control the exercise device's speed and other states and to cause the pulse rate of the user to be displayed on the monitor as the user progresses through his or her exercise regimen. Moreover, disclosed is an exercise device which has circuitry to generate a television type signal which may be displayed on a monitor which is capable of displaying images formed from such television type signals. Finally, a method is disclosed which incorporates the steps of detecting a exerciser's pulse rate, determining whether the exerciser's pulse rate is within a target heart rate range, controlling an exercise device in accordance with the exerciser's pulse rate, and displaying the exerciser's pulse rate on a monitor of the type described in this patent document.

14 Claims, 14 Drawing Sheets

PULSE RATE CONTROLLED EXERCISE SYSTEM

SPECIAL NOTICES

A microfiche Appendix has been provided which lists the program listings of the computer program which may control the pulse rate controlled exercise systems according to the present invention. There are xxx microfiche sheets, totaling yyy microfiche frames.

A portion of the disclosure of this patent document contains subject matter which is subject to copyright protection. The copyright owner has no objection to the facsimile reproduction by anyone of the patent document or the patent disclosure, as it appears in the U.S. Patent and Trademark Office patent files or records, but otherwise reserves all copyright rights whatsoever.

BACKGROUND OF THE INVENTION

1. Field of the Invention

The present invention relates generally to the field of exercise devices and systems. More particularly, the present invention relates to the field of exercise devices and systems that incorporate electronic control systems. Even more particularly, the present invention relates to the field of exercise devices and systems that incorporate electronic control systems that are controlled via the measurement of a user's heart or pulse rate.

2. Background Art

It is well known that various forms of exercise provide numerous emotional and physical benefits. Cardio vascular or aerobic exercise is one form of beneficial activity in which a person may engage. Aerobic exercises include activities that require a person's body to consume and process large amounts of oxygen. As a result of such oxygen consumption, aerobic exercises can improve the performance and operation of a person's respiratory and circulatory systems. Additionally, it is well known that a regimented program of aerobic exercise can result in improved weight loss and maintenance as well as stress management. Aerobic exercises often include such forms of physical exertion as dancing, running, walking, swimming, biking, stationary biking, etc.

Typically, a person may engage in an aerobic activity for a period of time every other day. Some people engage in various forms of aerobic exercise in a manner so that each day involves a different form. For example, it is not uncommon for a person to run for thirty minutes one day and bicycle for 20 miles on the following day. This form of exercise variance is commonly referred to as "cross training." Cross training helps to alleviate boredom and bodily adaptation often experienced with aerobic exercise.

While aerobic activity promotes better health generally, activities which are often thought of as being "aerobic" also provide specific benefits at different exertion levels. For example, it is quite possible for a person to engage in an activity in such a manner that he or she will burn fat as opposed to increase muscle mass. Moreover, it is quite possible to experience varying exercise effects by exerting corresponding amounts of effort. The amounts of effort that a person must realize in order to experience varying exercise effects directly relates to that person's heart rate during his or her exercise regimen. The following table illustrates the various exercise states or ranges in which a person may or may not wish to engage in order to achieve, or to not achieve, the corresponding result.

TABLE 1

TARGET HEART RATE RANGES

| HEART/PULSE RATE RANGE | % OF MAXIMUM HEART RATE |
|---|---|
| Fat Burning Range | 50–60% |
| Healthy Heart Range | 60–70% |
| Aerobic Training Range | 70–80% |
| Anaerobic Training Range | 80–90% |
| Red Line Range | 90–100% |

In order for a person to realize the above-listed exercise states he or she must realize the identified heart rate ranges during an exercise regimen. These heart rate ranges are commonly referred to as a "target heart rate ranges" which are percentages against a person's maximum heart rate. Generalized formulae have been developed to determine the extremes of a person's personal target heart rate ranges. One well known formula is commonly referred to as the "Age Adjusted Formula" which is defined by the mathematical equation: Threshold Point=(220–Age)×(% intensity desired)

For example, a user of 35 years of age who wanted to work out in the aerobic training range would have a low threshold point of 129.5 heart beats per minute and a high threshold point of 148 heart beats per minute. In other words, the person just mentioned would want to maintain his or her heart rate within a range of 129.5–148 heart beats per minute in order to realize an aerobic effect.

Another method of calculating a person's heart rate ranges is known as the "Karvonen Formula." This well known formula is defined in relation to a person's resting heart rate (RHR) and heart rate reserve. The formula is defined by the following equation: Threshold Point=RHR+(HRR×% intensity desired)

For example, a person with a RHR of 80 beats per minute and a known heart rate reserve of 100 beats per minute who wants to workout in the aerobic training range would have a lower threshold point of 150 beats per minute.

Even though the benefits of exercise are well known, people often start an exercise program only to realize less than satisfactory results. For some people, maintaining a regimented exercise program can present several problems. For example, people often get bored with activities in which they repeatedly engage. Engaging in the same activity for an extended period of time without a change in scenery or effort level can result in great boredom thereby ultimately causing a person to discontinue his or her exercise program no matter how good for the person such a program may be.

Another problem found with staying attentive to an exercise program or regimen is often seen where a person engages in the same form exercise activity for an extended period of time to the point where his or her body adapts or becomes used to the program. That is, if a person does not constantly challenge himself in engaging in various degrees of effort, his or her body may become used to the particular level of activity to the point where no beneficial exercise effect can be realized.

Yet another problem may be seen where a person believes she is performing aerobically, or in some other desired exercise range (i.e. see table above) but is actually be performing in some other non-desired range. For example, a person may be engaging in a dangerous heart red line range when they actually wish to be engaging in an aerobic range.

Various attempts have been made to solve some of the above-listed problems. The following background discussion outlines some of the proposed solutions.

Generally, aerobic exercise has become highly intertwined with modern technology. That is, solid state technology has been implemented into exercise devices to provide 'hi-tech' control and reporting systems in an effort to make exercise more physically and mentally rewarding. Exercise devices come in numerous varieties which include for example, stationary rowers, stationary ski machines, stationary stair climbers, stationary bicycles, and treadmills to name a few. In fact, exercise devices have grown increasingly complex in terms of the electronic circuitry used to control, monitor, and report various machine ad performance functions.

In U.S. Pat. No. 5,135,447 to Robards, Jr. et al., for example, an exercise apparatus for simulating stair climbing commonly referred to as a "stepper" is disclosed. The stepper of the '447 patent has the ability to provide different forms of exercise work-out sessions such as those that involve hill climbing and random effort/exertion levels. Moreover, the stepper of the '447 patent appears to be able to display, on a custom, built-in display panel that is integral with the exercise apparatus, calories burned per hour, the total calories one has burned during his or her work-out session, the number of floors climbed, etc. The stepper of the '447 patent does not allow the user of the apparatus to change his scenery, his effort level based on his actual heart rate, etc. In other words, a user of the stepper of the '447 patent may never really know if his or her exercise regimen is actually aerobic or whether his or her heart rate is within his or her desired target heart rate ranges. Moreover, it is believed that boredom may set in with continued use of a device like that of the '447 patent thereby eliminating the desire to use such a device.

Disclosed in U.S. Pat. No. 3,395,698 to Morehouse is a physiologically paced ergometric system in which a foot pedaling device is equipped with a heart beat rate meter. The rate of the foot pedaling device may be controlled in accordance with the heart beat rate of a user of the device. In addition, a pair of alternatively flashing lights act as a metronome which can inform the user to either speed-up or slow-down his or her exercise regimen. While the device of the '698 patent may incorporate some forms of feedback both in terms of exercise resistance controls and of visual speed indications, such controls and indications are done via a custom, built-in display (i.e. alternatively flashing lights).

Disclosed in U.S. Pat. No. 4,998,710 to Watterson et al. is an exercise cycle that has a computer which is used to generate signals to control the resistance of the exercise cycle in order to regulate the heart rate of the user. Additionally, the exercise cycle of the '710 patent incorporates a custom display panel which is used to report a user's heart rate as he or she progresses through his or her exercise regimen. The exercise cycle of the '710 patent provides that the pulse rate of a user is detected via an ear clip sensor. Such ear clips are well known in the art to provide less than desirable readings of a user's pulse rate thereby limiting the ability of any control circuitry to effectively determine if a user is exercising outside of his or her personal target heart range.

Disclosed in U.S. Pat. No. 4,848,737 to Ehrenfield is a cardiovascular exercise ladder device which provides sensors for monitoring the heart rate of a user and a microprocessor which adjusts the speed of the exercise ladder so that the a desired heart rate is reached and maintained. Additionally, the '737 patent appears to show the use of a display panel which is integral with the exercise ladder structure. The display panel may display heart rate and ladder rung speed. As with the patents mentioned above, the display panel of the '737 patent is a custom, built-in display panel.

Disclosed in U.S. Pat. No. 4,278,095 to Lapeyre is an exercise monitor system and method in which a user of the system may see his pulse rate displayed on a television set as he engages in an exercise work out session. Moreover, as the user speeds up or slows down during his exercise regimen, images displayed on the monitor are moved at corresponding speeds. No machine control is provided to effectuate an alteration of the user's heart rate. Thus, a user may have difficulty achieving a desired exercise range.

Other attempts have been made to solve the various problems associated with performing aerobic like exercises mentioned above. For example, one such exercise system, the VIDEO CYCLE, is a exercise bicycle/monitor combination in which the resistance of the user's exercise bicycle is adjusted according to a pre-programmed sequence of bicycle riding terrain instructions which are sent to the user's bicycle via the monitor screen. The pre-programmed terrain scenarios are maintained on a never changing video tape. There is no machine control based on the user's heart rate or the like. Finally, it is believed that the user will ultimately bore of the canned, pre-programmed videos thereby possibly eliminating the desire to engage in exercise by engaging in use of the exercise bicycle.

Finally, disclosed in the SEARS AND ROBUCK catalog is a treadmill/monitor combination in which a user's pulse rate is monitored and displayed on a custom display device which appears to incorporate a built-in LED or LCD display panel. Additionally, information about the effort level on a user's workout and the work-out profile (i.e. hill profile, etc.) may be provided on a television set. The treadmill/monitor combination does not provide interactive motor control. Moreover, while the treadmill/monitor combination involves sophisticated technology, the combination shown in the advertisement is not interactive in any sense. That is, like the other systems mentioned above, the videos displayed on the television are canned videotaped images which never change. As such, use of the combination, as with the other systems described above, may result in boredom thereby possibly hindering the desire to use the combination.

The invention discussed below and defined by the appended claims, overcomes the above mentioned problems and provides features and advantages not shown, suggested, or taught to date.

SUMMARY OF THE INVENTION

It is an object of the present invention to solve the above mentioned problems inherent in the structures and usage of existing exercise devices and systems which incorporate means for detecting a user's pulse rate and for controlling the exercise devices accordingly.

It is a further object of the present invention to provide a pulse controlled exercise system which will remain mentally and physically stimulating to use over extended periods of time to thereby enhance exercise level performance and satisfaction.

It is a further object of the present invention to provide a method of controlling a person's exercise performance to alleviate boredom and to enhance exercise results and to promote exercise device and system usage.

It is yet a further object of the present invention to provide a pulse controlled exercise system which allows a user of the system to constantly be aware of his pulse rate as he or she progresses through his or her work out regimen by displaying the user's pulse rate on a monitor which is capable of displaying image formed from television signals.

These and other objects of the present invention are accomplished by providing a pulse controlled exercise system having an exercise device, a monitor capable of displaying images formed from television signals, a pulse rate sensor for sensing the pulse rate of a user of the pulse controlled exercise system, and a controller coupled to the pulse rate sensor, to the exercise device, and to the monitor. The controller is used to control the exercise device and to cause the pulse rate of the user to be displayed on the monitor.

The invention also provides for a pulse controlled exercise system comprised of a base unit that has a first transmitter, a first receiver, and a first controller. Moreover, a pulse rate sensor for sensing the pulse rate of a user of the exercise system is included. Also, a pulse rate transmitter for transmitting the pulse rate of a user of the exercise system is included in the system. Moreover, an exercise device that is part of the system has a second controller for controlling the speed of the exercise device, a speed sensor for sensing the speed of the exercise device, a second transmitter for transmitting the speed of the exercise device and for transmitting the pulse rate, and a second receiver for receiving instructions from the base unit to modify the speed of the exercise device and for receiving the pulse rate transmitted by the pulse rate transmitter. Finally, a monitor which is capable of displaying images formed from television signals is coupled to the base unit and is used for displaying the user's pulse rate.

The invention also provides for a pulse controlled exercise system having a base unit having a first transmitter, a first receiver, and a first controller. Also, the system has a pulse rate sensor for sensing the pulse rate of a user of the system, a pulse rate transmitter for transmitting to the base unit the pulse rate of the user, an exercise device having a second controller for controlling the speed of the exercise device, a speed sensor for sensing the speed of the exercise device, a second transmitter for transmitting the speed of said exercise device to the base unit, and a second receiver for receiving instructions from the base unit to modify the speed of the exercise device. Additionally, the system has a monitor which is capable of displaying images formed from television signals and which is coupled to the base unit for displaying the user's pulse rate.

The invention also provides for an exercise device that has a resistance system, a user interface, and signal generation circuitry for generating television signals which may be processed for display on a type television monitor.

Finally, the invention also provides a method of controlling a person's exercise performance to enhance exercise results and satisfaction. The method is adapted for use with an exercise system which has a monitor for displaying a user's pulse rate and which is capable of displaying images formed from television signals. The method comprises the steps of detecting the user's pulse rate, determining whether the user's pulse rate is within a target heart rate range, controlling an exercise device in accordance with the user's pulse rate, displaying the user's pulse rate on the monitor, and displaying images on the monitor which are formed from television signals.

BRIEF DESCRIPTION OF THE DRAWINGS

The invention is explained in detail by way of example and with reference to FIGS. 1–7 in which.

DETAILED DESCRIPTION OF THE PREFERRED EMBODIMENTS

Figure 1:
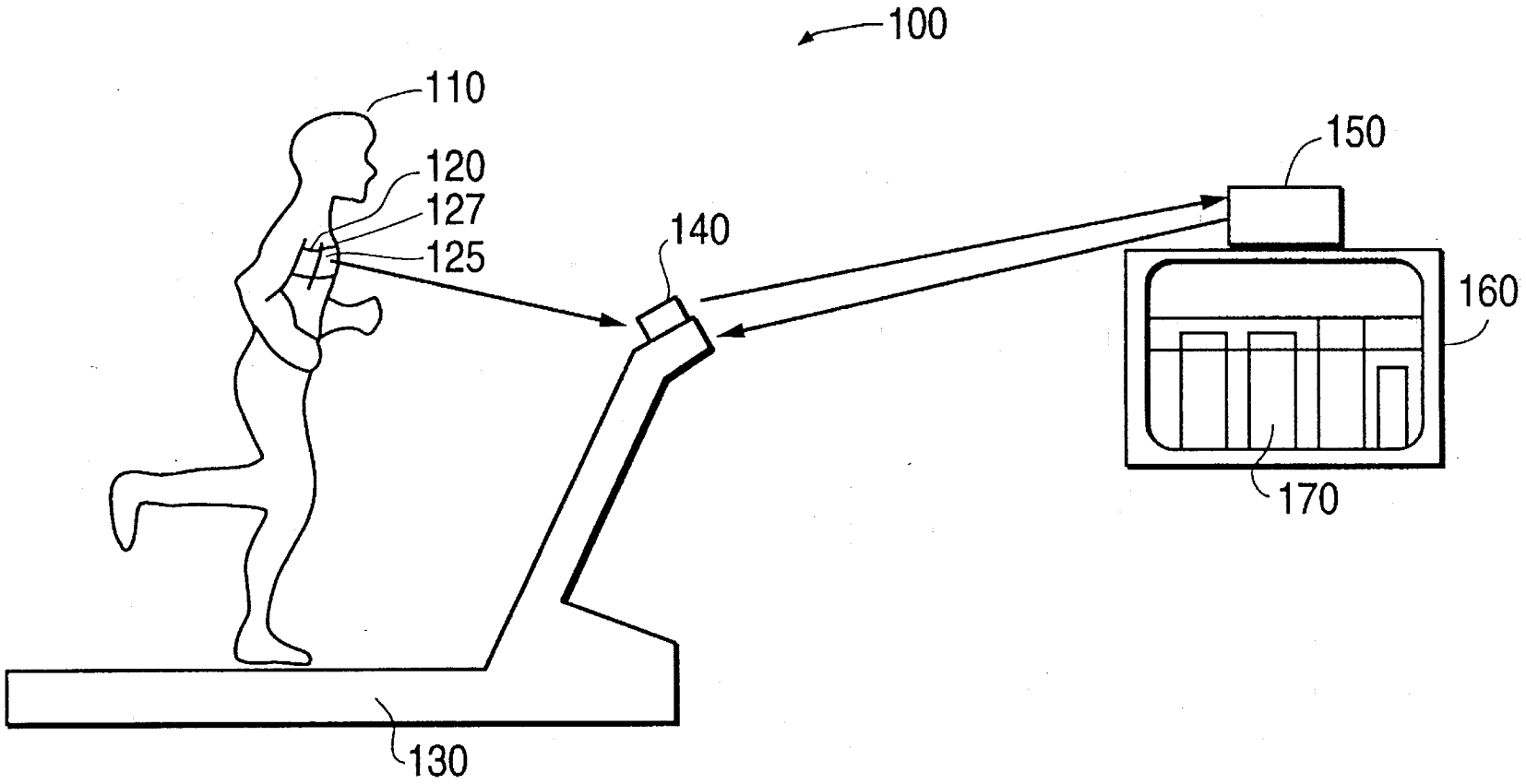
FIG. 1 is a system diagram in which a user strides on a treadmill device which is controlled according to the user's pulse rate and in which the user's pulse is displayed on a monitor capable of displaying images formed from television signals.

The following detailed description of the preferred embodiments is presented with reference to FIGS. 1–7. It should be understood that alternative designs are encompassed by the invention, which is limited only by the appended claims. The reference numerals used in the figures and in the following detailed description are the same where appropriate.

Generally, with regard to the following detailed description of the preferred embodiments, the phrases "pulse rate" and "heart rate" shall mean the rate at which a system user's heart beats. That is, the term "rate" means the number of beats a user's heart will realize in the period of one minute. In the following discussion a user's pulse rate may be referred to by the mnemonic "BPM" which stands for BEATS PER MINUTE. Moreover, the mnemonic "IBI" may be used to refer to a user's INTER-BEAT INTERVAL or the amount of time between successive heart beats.

Referring now to FIG. 1, a pulse controlled exercise system 100 is shown in which a user 110 of the system is shown to be running on treadmill device 130. The treadmill device 130 has a revolving belt (not shown) on which user 110 strides. Moreover, user 110 is wearing a chest belt 120 which is equipped with a pulse rate monitor/sensor device 125 and a pulse rate transmitter 127. Pulse rate sensor 125 senses user 110's pulse rate and pulse rate transmitter 127 transmits user 110's pulse rate to control center 140.

Control center 140 is shown mounted on treadmill device 130. Control center 140 has a transmitter and two receivers (not shown). Additionally, control center 140 has a controller (not shown) for controlling a user interface (not shown) and for controlling the electric motor and, ultimately, the resistance level, (not shown) of treadmill device 130.

The transmitter found in control center 140 transmits signals representing both the user's pulse rate and possibly the states in which the treadmill device 130 operates. Such operation states may include current speed, current incline degree, time, etc. One of the receivers of the control center 140 receives transmissions from the pulse rate sensor device 125 as mentioned above. The other receiver found in control center 140 receives motor control instructions from base unit 150.

Base unit 150 is shown to be resting on monitor 160 with a transmitter (not shown), a receiver (not shown), a controller (not shown), and a video interface (not shown). The controller that resides in base unit 150 processes the machine states received from control center 140 and the user's pulse rate also received via control center 140. Base unit 150 also determines if the user's pulse rate is within that user's target heart rate range to ultimately instruct treadmill device 130 to either speed-up or slow-down and to cause user 110 to either work harder (i.e. run faster on treadmill device 130) or work softer (e.g. run slower on treadmill device 130) respectively. Additionally, base unit 150 will cause the user 110's pulse rate to be displayed on monitor 160.

Monitor 160 is shown as a video monitor which is capable of displaying images formed from television signals. For example, monitor 160 may be a television set of any number of varieties and/or possibly a projection television system. Displayed on screen 170 is a bar chart graphic image which represents user 110's pulse rate over time. Each vertical bar represents a given pulse rate (e.g. 120 BPM). The right most vertical bar displayed on screen 170 is outside the particular range which corresponds to the user 110's target heart rate range and which is represented by the two horizontal, parallel lines that run across screen 170.

It should be understood that while pulse controlled exercise system 100 incorporates treadmill device 130 as the exercise device, other exercise devices that have electric motors and/or resistance means and which are capable of providing various degrees of resistances may also be used. Moreover, while a chestbelt equipped with a heart rate sensor is shown as part of pulse controlled exercise system 100, other forms of well-known heart rate sensors/monitors may be used. Such other forms of heart rate monitors include, but are not limited to, finger tip sensors, ear clip sensors, and head band sensors.

Figure 2:
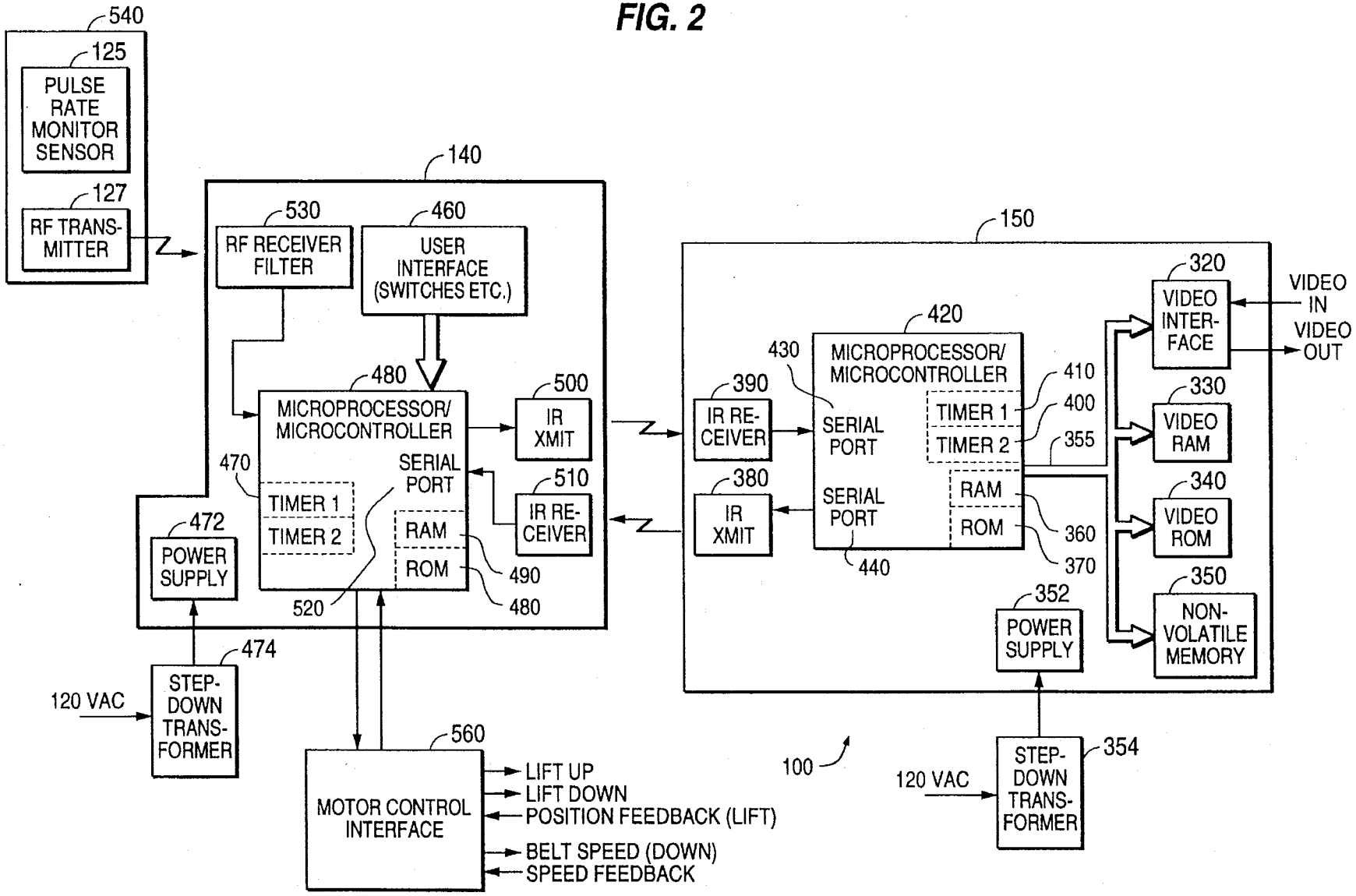
FIG. 2 is a block schematic diagram corresponding to the system shown in FIG. 1.

Referring now to FIG. 2, therein depicted is a block schematic diagram which corresponds to the structure of the system shown in FIG. 1. Reference numeral 540 refers to that portion of chest belt 120 of FIG. 1 that maintains circuitry for monitoring user 110's pulse rate and for transmitting that pulse rate to control center 140. Pulse rate monitor/sensor 125 is of a conventional type which is worn around the user's chest and which receives pulse rate indicia from user 110's chest. Preferably, the pulse rate monitor/sensor 125 and pulse rate transmitter 127 combination is similar to such a device manufactured by POLAR, INC. of Port Washington, N.Y. (e.g. models VANTAGE XL or ACCUREX).

Control center 140 is shown in FIG. 2 as having a radio frequency receiver 530 which is connected to microprocessor/microcontroller 470 and which receives radio broadcasts from pulse rate transmitter 127 which correspond to user 110's pulse rate. The radio frequency at which radio frequency receiver 530 receives broadcasts from pulse rate transmitter 127 should be set to the same frequency as pulse rate transmitter 127.

Also shown as part of control center 140 is user interface 460 which is connected to microprocessor/microcontroller 470. User interface 460 may incorporate rotary dials or switches, LED displays, LCD displays, push button switches, keypads, and other similar conventional input/output means for gathering and displaying information relating to a user's work-out regimen. Such information may include a user's height, weight, and age. Additionally, such information may include requests related to the type of work-out regimen in which to engage, etc. Such information may also be displayed on monitor 160 via video interface 320 as will be discussed below. Preferably, a rotary switch is incorporated into user interface 460 to allow the user to select from a series of menu choices which are related to the previously mentioned information and which are displayed as screens on monitor 160. User selection systems which display menu choices as screens on monitors will be apparent to those skilled in the art.

Microprocessor/microcontroller 470 controls both user interface 460 and motor control interface 560. Microprocessor/microcontroller 470 is connected to read only memory (ROM) 480 and to random access memory (490). Programming logic for microprocessor/microcontroller 470 is stored in ROM 480 and in RAM 490 to control user interfaces like that of user interface 460 and to perform motor resistance monitoring and control of motor control interfaces like that of motor control interface 560 will be apparent to those skilled in the arts of exercise device control and machine control generally.

Also, microprocessor/microcontroller 470 is connected via serial port 520 to infrared transmitter 500 and to infrared receiver 510. Infrared transmitter 500 and infrared receiver 510 are like those transmitters and receivers used with television sets for providing remote control of such television sets and will be apparent to those skilled in the art.

Infrared transmitter 500 transmits pulse rate information about user 110 to infrared receiver 390. Additionally, infrared transmitter 500 may transmit exercise device state information to infrared receiver 390. Such machine state information may include, for example, machine speed, machine/belt incline, etc. It should be understood that depending on the machine state information sought to be monitored and controlled, particular sensors (e.g. speed sensors) must be included within the circuitry of the exercise device to be controlled.

Infrared receiver 510 receives motor control instructions from infrared transmitter 380 which, in turn, are communicated via microprocessor/microcontroller 470 to motor control interface 560.

Motor control interface 560 is shown to provide for belt speed control (i.e. speed) and incline control (i.e. lift) of treadmill device 130. Where an exercise device other than a treadmill is chosen, the motor control interface may be different. For example, if the exercise device that is chosen is a stepper, the motor control interface may respond to instructions to change speed, stepping resistance, etc. Stepper like instructions may be transmitted and received over infrared transmitters 500 and 380 and receivers 510 and 390 in similar fashion to the transmissions of treadmill device motor control instructions.

Controller 140 maintains a standard power supply system comprised of elements 472 and 474 which will be apparent to those skilled in the art.

Turning now to base unit 150, a microprocessor/microcontroller 420 is shown connected to an infrared receiver 390 via a serial port, an infrared transmitter 380 via a serial port, to a ROM 370, to a RAM 360, and to a video interface bus 355. Connected to video interface bus 355 is video interface 320, video RAM 330, video ROM 340, and an additional non-volatile memory 350. Timing for microprocessor/microcontroller 420 is done via timing circuitry found at timer-1 and timer-2 (ref. numeral 400). Power is supplied to base unit 150 via a conventional power supply system comprising elements 352 and 354. The power supply system is well-known in the art.

Video interface 320 displays information directed for output from microprocessor/microcontroller 420. Additionally, video interface 320 may process video signals (via "video in") to provide various image display modes which are discussed below. The structure of video interface 320 is such that it should produce a "video out" signal which may be displayed on monitor 160. As mentioned above, monitor 160 may include a conventional home television set or projection television set or the like. The structure of video interface is similar to that found in video cassette records, video cameras, laser/video disc players, etc., is convention and will be apparent to those skilled in the art.

As mentioned above, video interface 320 produces a video out signal which may be displayed on monitor 160. The video out signal is a standard television signal which may be displayed on a home television set. Moreover, the video out signal produced by video interface 320 is similar or like the signal produced via a video cassette recorder, video cameras, laser/video disc players, etc. For example, video interface 320 may superimpose data related to a user's pulse rate on a video in signal and covert the combination video signal to a radio frequency signal which may be received and displayed on monitor 160.

It will be understood from the above discussion of the structure of video interface 320 that such structure may be configured to consecutively switch between displaying incoming television or video signals on monitor 160 and displaying pulse rate related and work-out related information on monitor 160 in "image switching" fashion. In other words, when video interface 320 is configured in a manner just described, images related to a user's work-out regimen (i.e. pulse rate, speed, etc.) will be displayed only when video interface 320 switches or turns-off the display of other television or video signals. Moreover, video interface 320 may be configured either to switch periodically between causing the video in signal to be displayed and causing the user's pulse rate information to be displayed or to display only the user's pulse rate information or the video in signal. As mentioned above, FIG. 1 shows such an image switching configuration in that only user 110's pulse rate information is currently being displayed.

Image switching is well known in the art. For example, video cassette recorders (VCR's) often provide on-screen programming capabilities. Such on-screen programming systems provide users with the capability to program their VCR's to turn on or off at particular times and to record television programs at desired times.

Another example of image switching is seen in the field of home video games. It is quite common for a video game device to maintain switching circuitry which will effectively override the reception of certain television signals by a television set on particular channels to thereby turn-off such transmission when the video game device displays its game screen images.

Figure 3:
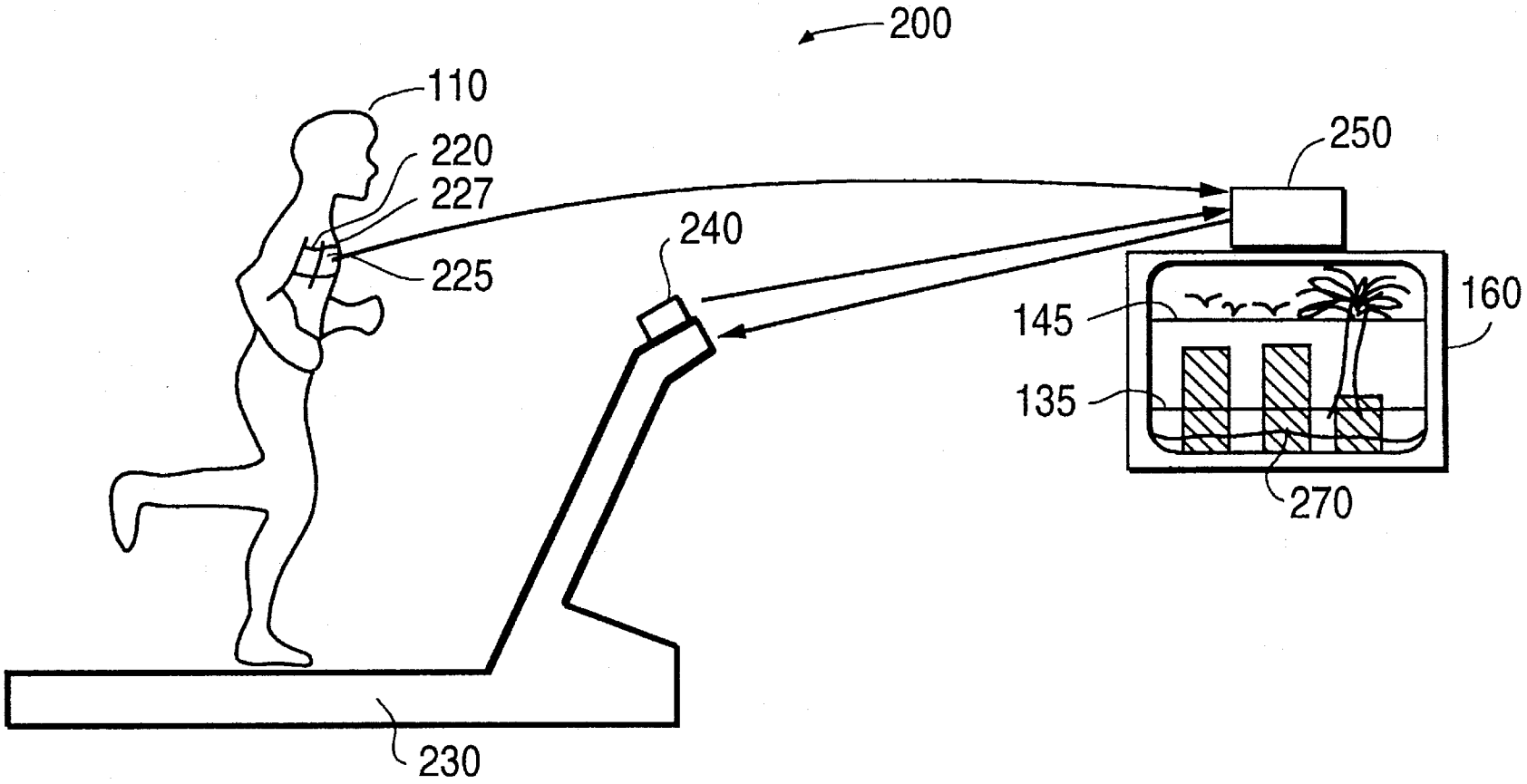
FIG. 3 is a system diagram of another embodiment of present invention in which a user strides on a treadmill which is controlled according to the user's pulse rate and in which the user's pulse rate is displayed on a monitor capable of displaying images formed from television signals.

Video interface 320 may also be configured to operate in an "image mixing" mode to render a user's work-out regimen more enjoyable to thereby possibly eliminate the problems mentioned above. It is often the case that a user may choose to watch a television program which is either broadcast from a television station or which is recorded on video tape. Where the user desires image mixing, his pulse rate may be displayed in graphic or non-graphic form, for example, on top of or in front of other video and/or television signals as is illustrated in FIG. 3.

Video interface 320 provides for both image switching and image mixing by being able to receive video signals and to process such signals according to particular operation mode selected by user 110 during start-up of the system. In both modes, video RAM 330, video ROM 340, and non-volatile memory 350 are used in the conventional manner.

With regard to the system shown in FIGS. 1 and 2, it should be understood that while transmissions and receptions either of a user's pulse rate information or of an exercise device's motor control information are achieved via a combination of radio frequency and infra red technologies, such transmissions and receptions could also be achieved by way of hard wiring in a conventional manner. While hard wiring may be less costly than providing for radio or infra red communications, hard wiring is not as elegant a solution to communicating the information sent and received in the above-described system. Moreover, lengthy wires present numerous problems which are well known.

Finally with regard to the system shown in FIGS. 1 and 2, it should be understood that while control center 140 and base unit 150 each have a microprocessor/microcontroller, it would be quite possible to have a single "system" controller device which would perform the functionality of microprocessor/microcontroller 470 (e.g. user interface and motor control) and of microprocessor/microcontroller 420 (e.g. logic control and communications). Such a system controller could be housed in a section of an exercise device. Moreover, if the system controller were to be located in a section of the treadmill device 130, for example, means for providing input television type signals to and output television type signals from a section located on the treadmill device 130 would be possible according to the teachings of the present invention.

Referring now to FIG. 3, therein depicted is another preferred embodiment of the present invention which is similar to the system shown in FIG. 1. However, system 200 provides for the transmission of a user's pulse rate via infra-red technology directly to base unit 250. Infra-red technology is more fault tolerant than radio frequency technology during transmission. Moreover, infra-red technology does not require the government licenses which radio frequency technology often requires. Additionally, infra-red technology may allow for transmissions over greater physical distances.

FIG. 3 shows a pulse controlled exercise system 200 in which user 110 of the system is shown to be running on a treadmill device 230. The treadmill device 230 has a revolving belt (not shown) on which user 110 strides. Moreover, user 110 is wearing a chest belt 220 which is equipped with a pulse rate sensor device 225 and a infrared pulse rate transmitter 227. Pulse rate sensor 225 senses user 110's pulse rate and infrared pulse rate transmitter 227 transmits user 110's pulse rate to base unit 250.

Control center 240 is mounted on treadmill device 230 and has a transmitter (not shown) and a receiver (not shown). Additionally, control center 240 has a controller (not shown) for controlling a user interface (not shown) and for controlling the motor/resistance unit (not shown) of treadmill device 230. The transmitter may transmit signals representing the various states in which the treadmill device 230 operates and which are detected by means which are well known in the art (e.g. speed sensors). Such states can include machine speed, machine incline degree, time of work-out, time-remaining in work-out, etc. The receiver maintained in control center 240 receives motor and/or resistance control instructions from base unit 250.

Base unit 250 is shown to be resting on monitor 160 and is equipped with a transmitter (not shown), a receiver (not shown), a controller (not shown), and a video interface (not shown). The controller that resides in base unit 250 processes the machine states received from control center 240 and the user's pulse rate received via infrared pulse rate transmitter 227. Base unit 250's controller is equipped in such a way that it determines if the user's pulse rate is within that user's target heart rate range and instructs treadmill device 230 to either speed-up or slow-down ultimately to cause the user to either work harder (i.e. run faster on treadmill device 230) or work softer (e.g. run slower on treadmill device 230) respectively. Additionally, base unit 250's controller will cause the user's pulse rate to be displayed on monitor 160.

It should be understood that while base unit 250 is shown to be resting on top of monitor 160, the circuitry making up base unit 250 may be located elsewhere. For example, it would be quite possible to locate base unit 250's circuitry in the exercise device directly. Moreover, base unit 250's circuitry could be incorporated into monitor 160 as a standardized exercise monitoring system.

Turning now to monitor 160, a video monitor which is capable of displaying images formed from television signals and which is connected to Base Unit 250 is shown. As mentioned above, monitor 160 may be a television set of any number of varieties or may even be a projection television set. Depicted on screen 270 is a bar chart which represents the user's pulse rate over time. Each vertical bar represents a given pulse rate (e.g. 148 BPM). User 110's target heart rate range corresponds to the two horizontal, parallel lines that run across screen 270. The particular heart rate range may correspond to the fat burning range, the aerobic range, etc., etc. The images related to user 110's pulse rate are generated by circuitry housed in base unit 250.

Also depicted on screen 270 is a background image which is overlaid with the pulse rate related graphic and text based information related to user 110's pulse rate as he continues throughout his exercise regimen. More specifically, the image depicted on screen 270 is a palm tree scene over which is a display of user 110's pulse rate in bar chart graphics form. The background images displayed on screen 270 may be images formed from television signals which are either broadcast and received from a television station, from a subscription television service connection, from a video cassette recorder (VCR), from a laser disc player, or from other similar television signal generation sources.

It should be understood that while pulse controlled exercise system 200 incorporates treadmill device 230, other exercise devices which have motors and/or resistance systems and which are capable of providing various degrees of resistance may also be chosen. Moreover, while a chestbelt equipped with a heart rate sensor is shown as part of pulse controlled exercise system 200, other forms of well-known heart rate monitors or sensors may be used. Such other forms of heart rate monitors/sensors include, but are not limited to, finger tip sensors, ear clip sensors, and head band sensors.

Figure 4:
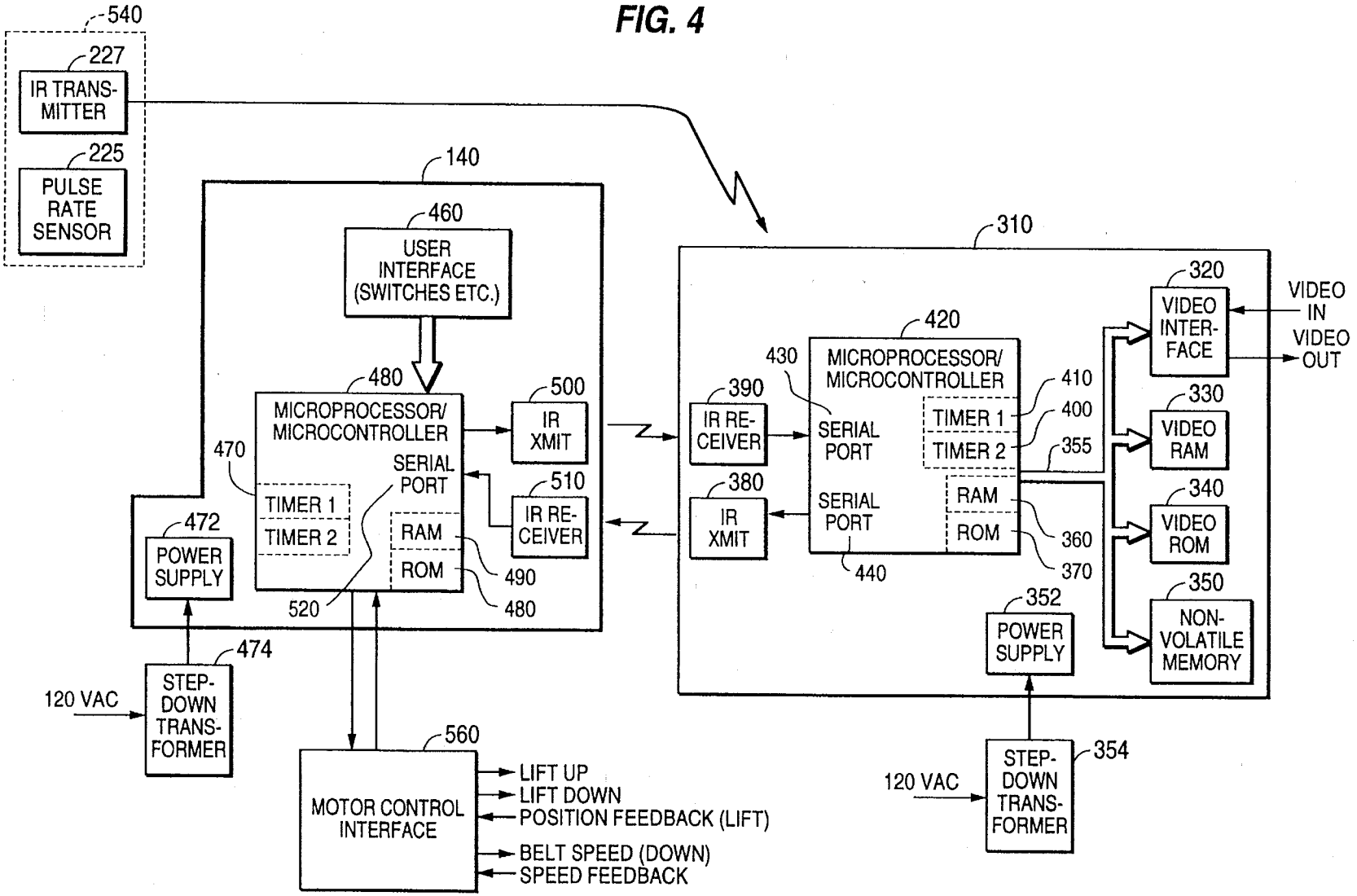
FIG. 4 is a block schematic diagram corresponding to the system shown in FIG. 3.

Referring now to FIG. 4, therein depicted is a block schematic diagram corresponding to the system shown in FIG. 3. Reference numeral 540 refers to that portion of chest belt 220 of FIG. 3 that maintains circuitry for monitoring user 110's pulse rate and for transmitting that pulse rate to base unit 250. Pulse rate monitor/sensor 225 is of a conventional type which is worn around the user's chest and which receives pulse rate indicia from user 110's chest. Preferably, the pulse rate monitor/sensor 125 and pulse rate transmitter 127 combination of choice is similar in design to such a device manufactured by POLAR, INC. which was mentioned above.

Shown as part of control center 140 is user interface 460. User interface 460 may incorporate rotary dials or switches, LED displays, LCD displays, push button switches, keypads, and other similar input/output means for gathering and displaying information relating to a user's work-out regimen. Such information may include a user's height, weight, and age. Additionally, such information also may include requests related to the type of work-out regimen in which to engage, etc. Such information also may be displayed on monitor 160 of FIG. 3 via video interface 320 as will be discussed below. Preferably, a rotary switch is incorporated to allow a user to select from a series of menu choices which are related to the previously mentioned information and which are displayed on monitor 160.

Microprocessor/microcontroller 470 controls both user interface 460 and motor control interface 560. Microprocessor/microcontroller 470 is connected to read only memory (ROM) 480 and to random access memory (490). Programming logic for microprocessor/microcontroller 470 is stored in ROM 480 and in RAM 490. Also, microprocessor/microcontroller 470 is connected via serial port 520 to infrared transmitter 500 and to infrared receiver 510. Infrared transmitter 500 and infrared receiver 510 are similar to those transmitters and receivers used in television sets for providing remote control of such television sets and will be apparent to those skilled in the art.

Infrared transmitter 500 transmits exercise device state information to infrared receiver 390. Infrared receiver 510 receives motor control instructions from infrared transmitter 380 which, in turn, are communicated via microprocessor/microcontroller 470 to motor control interface 560 for operation thereof.

Motor control interface 560 is shown to provide for belt speed control (i.e. machine speed) and incline control (i.e. lift) of treadmill device 130. Where an exercise device other than a treadmill is chosen, the motor control interface may be different. For example, if the exercise device that is chosen is a stepper, the motor control interface may respond to instructions to change speed, stepping resistance, etc. Stepper like instructions may be transmitted and received over infrared transmitters 500 and 380 and receivers 510 and 390 in similar fashion to the transmissions of treadmill device motor control instructions. Motor and/or resistance control of exercise devices will be apparent to those skilled in the art.

Controller 470 maintains a standard power supply system comprised of elements 472 and 474 which will be apparent to those skilled in the art.

Turning now to base unit 310 which corresponds to base unit 250 of FIG. 3, a microprocessor/microcontroller 420 is shown connected to an infrared receiver 390 via a serial port, an infrared transmitter 380 via a serial port, a ROM 370, a RAM 360, and a video interface bus 355. Connected to video interface bus 355 is video interface 320, video RAM 330, video ROM 340, and an additional non-volatile memory 350. Timing for microprocessor/microcontroller 420 is done via timing circuitry found at timer-1 and timer-2 (ref. numeral 400). Power is supplied to base unit 310 via a conventional power supply system comprising elements 352 and 354. Such a power supply system will be apparent to those skilled in the art.

Video interface 320 displays information directed for output from microprocessor/microcontroller 420. Additionally, video interface 320 may process video signals (via "video in") to provide various image display modes which are discussed below. The structure of video interface 320 is such that it should produce a "video out" signal which may be displayed on monitor 160. As mentioned above, monitor 160 may include a conventional home television set or projection television set or the like. The structure of video interface is similar to that found in video cassette records, video cameras, and laser/video disc players. Moreover, the structure of video interface 320 is conventional and will be apparent to those skilled in the art.

As mentioned above, video interface 320 produces a video out signal which may be displayed on monitor 160. The video out signal is a standard television signal which may be displayed on a home television set. Moreover, the video out signal produced by video interface 320 is similar or like the signal produced via a video cassette recorder, video cameras, laser/video disc players, etc. For example, video interface 320 may superimpose data related to a user's pulse rate on a video in signal and covert the combination video signal to a radio frequency signal which may be received and displayed on monitor 160.

In light of the discussion of video interface 320 above, video interface 320 may be configured to consecutively switch between displaying incoming television or video signals on monitor 160 (see FIG. 3) and displaying pulse rate related and work-out related information on monitor 160 in what is commonly referred to as "image switching" fashion. In other words, when video interface 320 is configured in a manner just described, images related to a user's work-out regimen (i.e. pulse rate, machine speed, etc.) will be displayed only when video interface 320 switches or turns-off the display of other television or video signals. As mentioned above, FIG. 1 shows such an image switching configuration.

Image switching is well known in the art. For example, video cassette recorders (VCR's) often provide on-screen programming capabilities. Such on-screen programming systems provide users of such system with the capability to program their VCR's to turn-on or off at particular times and to record television programs at desired times.

Another example of image switching is seen in the field of home video games. It is common for a video game device to maintain switching circuitry which will effectively override the reception of certain television signals by a television set on particular channels to thereby turn-off such transmission when the video game device displays its game screen images.

Video interface 320 may also be configured to operate in an "image mixing" mode to render a user's work-out regimen more enjoyable. Often, a user may choose to watch a television program which is either broadcast from a television station or which is recorded on video tape. Where the user desires image mixing, his pulse rate may be displayed in graphic form, for example, on top of other video and/or television signals as is illustrated in FIG. 3.

Video interface 320 provides for both image switching and image mixing by being able to receive video signals (i.e. referred to in FIG. 4 as "video in") and to process according to particular operation mode selected by a user of the system. In both modes, video RAM 330, video ROM 340, and non-volatile memory 350 are used in a conventional manner.

With regard to the operation of the pulse controlled exercise systems described above, the following discussion of the computer program used to implement system functionality assumes several points. First, it will be assumed that the user has turned on his pulse controlled exercise system by turning on and supplying power to the system's corresponding parts. Second, it will be assumed that the user is wearing a pulse rate sensor which has begun to detect and transmit the user's pulse rate. Finally, it will be assumed that the user will engage in some form of work out regimen on a treadmill device which will be instructed to either speed up or slow down and/or lift up or lift down depending on how the user (i.e. his heart rate) responds to various degrees of resistance.

Referring now to FIGS. *5a–5h*, therein depicted are flow charts that outline the operation of the computer program that provides much of the functionality of the pulse controlled exercise systems described above. Moreover, the discussion of the flow charts that follows, corresponds to the computer program listed in the program listings that have been attached to this patent document in a microfiche Appendix which was mentioned above. Specifically, the operations outlined in the flow charts will be carried out by microprocessor/microcontroller 420 as shown in FIGS. 2 and 4. Depending on the microprocessor/microcontroller that is chosen to implement a pulse controlled exercise system according to the teachings stated herein, the computer program outlined in the following discussion may be implemented in any number high level languages such as basic, pascal, C, C++. Alternatively, it may be desirable to implement to the computer program in a lower level language such as assembly language or even machine code if necessary.

The actual program should preside on a non-volatile memory such as a ROM for easy operation loading of instructions to microprocessor/microcontroller 420.

The geometric shapes shown in the flow charts indicate the following operations: a circle or a round oval indicates a terminal point or continuation/branch spot, a rectangular box indicates program steps (e.g. variable assignments, etc.), and diamonds indicate condition or test points where microprocessor/microcontroller 420 may check system variables and/or inquire as to other operation states. Finally, lines with arrow heads indicate the flow of operations to be carried out by microprocessor/microcontroller 420 during the course of a user's pre, mid, and post work-out regimen and during program execution.

Referring now to FIG. *5a*, the operation of the pulse controlled exercise systems described above begins at starting place 700. At step 702, program variables are initialized. Additionally, start-up screens and menu screens are displayed on a television type display monitor of the kind described above. Information about the user of the system including, but certainly not limited to, age, sex, name, and weight may be collected and stored in program variables.

Also performed at operation rectangle 702 is the calculation of the initial IBI or initial inter-beat interval, a pulse rate base line, and an initial median pulse (MP) rate. The IBI and the base line are calculated as a result of detecting pulses from a user's pulse rate monitor/sensor which are transmitted to a receiver coupled to the microprocessor/microcontroller that is running the program described here. The IBI is calculated by determining the amount of time between successive heart beats. The IBI may be calculated to a 1/1000th of a second.

The user's pulse rate is calculated by dividing 60 (i.e. 60 seconds) by the user's IBI. Once the pulse rate has been calculated ten times, a base line may be arranged by sorting the ten IBI's (i.e. "samples") in ascending or descending order in array or linked-list fashion in a random access memory. From the ten pulse rate samples detected, the MP may be selected.

At condition 704 the microprocessor/microcontroller will determine if the exercise device is in a pause condition. Typically, a pause condition signifies that the exercise device is not causing a motor to operate but is being powered nonetheless. If the exercise device is in the pause condition either initially when turned on or is selected during a user's work out regimen, the program will cause the exercise device to stop or stay stopped and will terminate. Termination of the program will be natural and may involve the display of a "good-bye" or a "sign off" screen on the video monitor.

If the pause condition is not in effect, the program next inquires as to whether the safety key plug of the exercise device is inserted into the exercise device. Well known in the art are the structures and designs of safety or emergency plug devices which cause immediate termination of power to any motor devices on an exercise device. It will be apparent to those skilled in the art to have microprocessor/microcontroller check and determine if the safety key plug is inserted or not. If not inserted, the program will immediately cause the exercise device to stop and will terminate as described above.

If the safety key plug is inserted the program will next inquire as to whether a countdown timer (CT1) variable has been running for more than 30 seconds. The 30 second time limit can change depending on particular design criteria. If the timer has not been running for more than 30 seconds, the program will (1) wait for 30 seconds or wait until the countdown timer is equal to 30 seconds before performing steps to calculate a user's IBI and median pulse (MP) rate.

Figure 5A:
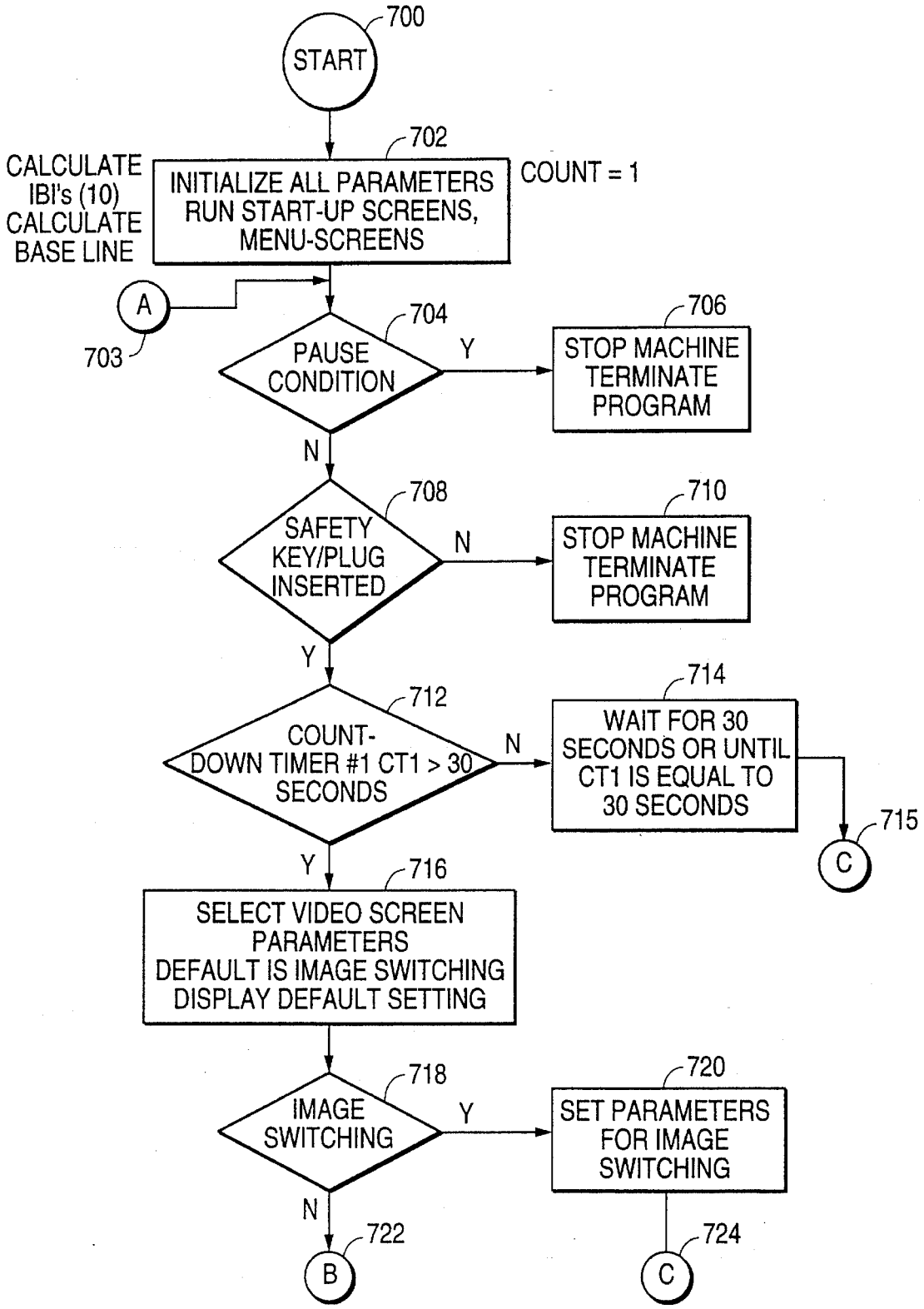
FIG. 5*a* illustrates the beginning of a flow chart which outlines the operation of the systems shown in FIGS. 1–4.
Figure 5B:
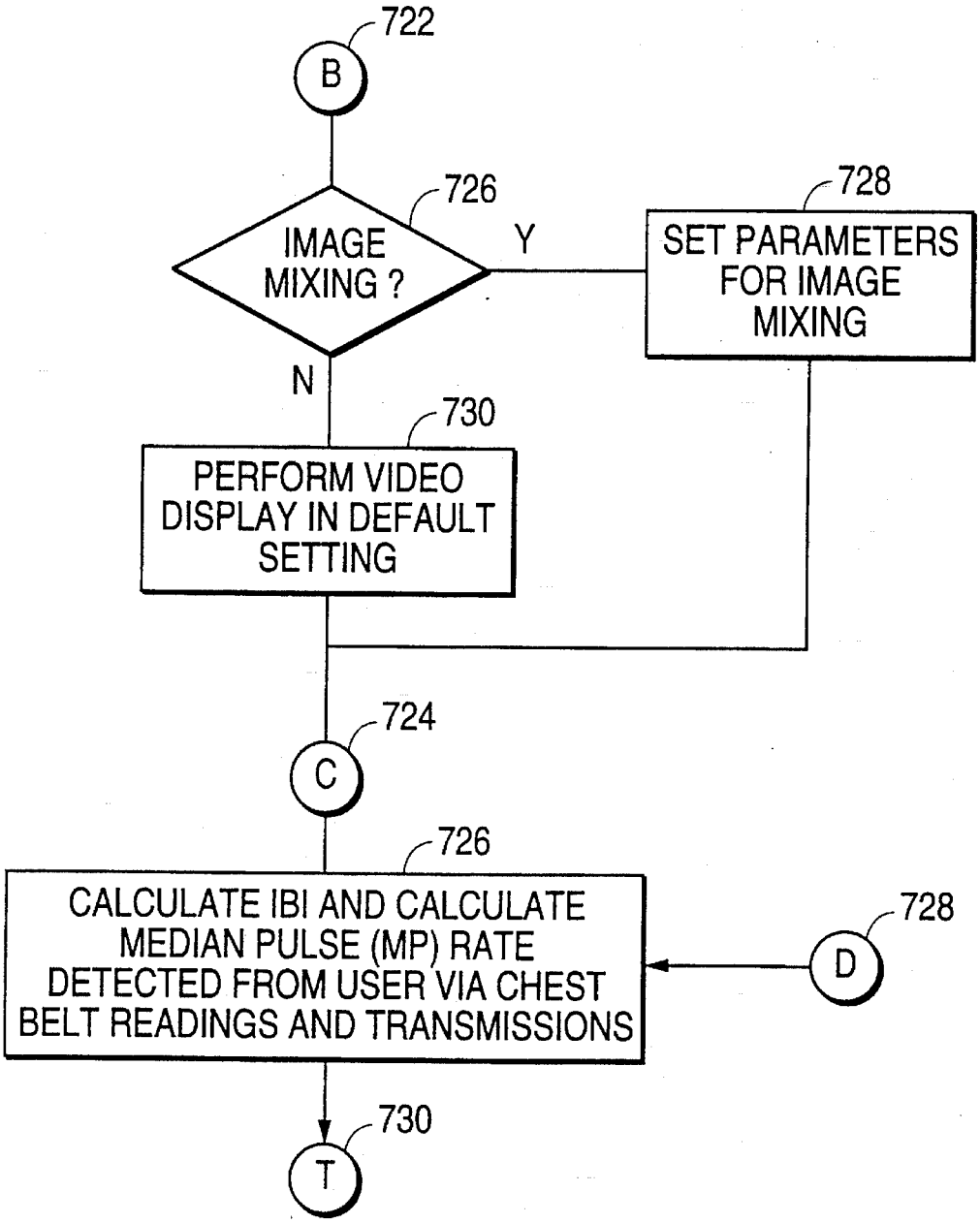
FIG. 5*b* is a continuation of the flow chart of FIG. 5*a;*

If CT1 has counted for more than 30 seconds, the program will perform a sequence of steps to select the desired video screen parameters designated in FIGS. 5*a* and 5*b* by reference numerals 718–730. The default setting includes image switching as described above (i.e. pulse rate will be displayed and then television signals will be displayed). The user will select video screen settings as he will with all user selectable parameters. That is, a user will be presented with a video screen menu on which may be listed instructions and choices from which the user may chose. This form of screen display should be "user friendly" and will be apparent to those skilled in the art of computer programming.

Figure 5C:
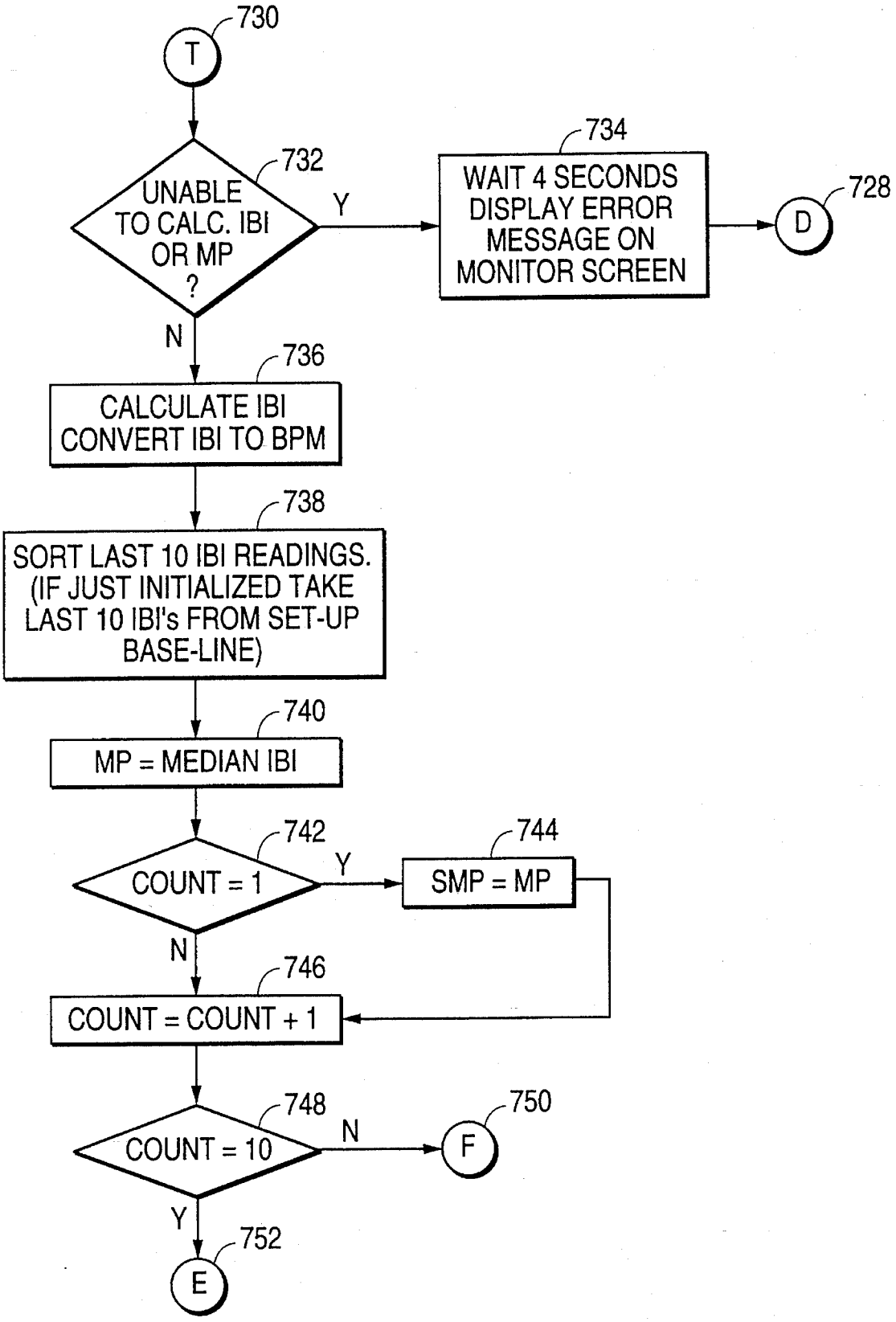
FIG. 5*c* is a continuation of the flow chart of FIG. 5*a;*

Referring now to FIGS. 5*b* and 5*c*, the program will attempt to calculate the user's IBI and MP as it did above. However, the base line is not produced by taking ten new pulse rate samples. Instead, the most current pulse rate sample will be placed in the array structure that holds the base line (i.e. the last ten pulse rate samples) at the appropriate place so that the MP may be properly selected.

Shown starting at terminal point "T" 730, the program will check if it is unable to calculate the IBI or the MP. If the user's chest belt pulse rate sensor has failed, or if the user's has stepped away from the exercise device, or if the system has failed for any other reason, the IBI may not be calculated. If the program cannot calculate the IBI, the program will wait 4 seconds, display error messages on the monitor display, and loop back to operate at terminal point "D" 728.

If the program is able to calculate the IBI, the program will convert the IBI to BPM at operation rectangle 736 the operation of which was described above. Also, the last ten IBIs will be sorted as described above at operation rectangle 738. Finally, the MP will be selected at operation rectangle 740.

The program will next inquire as to whether a counter variable COUNT is equal to '1' at condition point 742 If COUNT does equal '1', a storage variable SMP will be set to the median pulse at operation rectangle 744. Finally, COUNT will be incremented by one at operation rectangle 746.

The program will next inquire as to whether COUNT is equal to 10. If COUNT equals 10, operation will continue at operation section 752. Otherwise operation will continue at operation section 750.

Figure 5D:
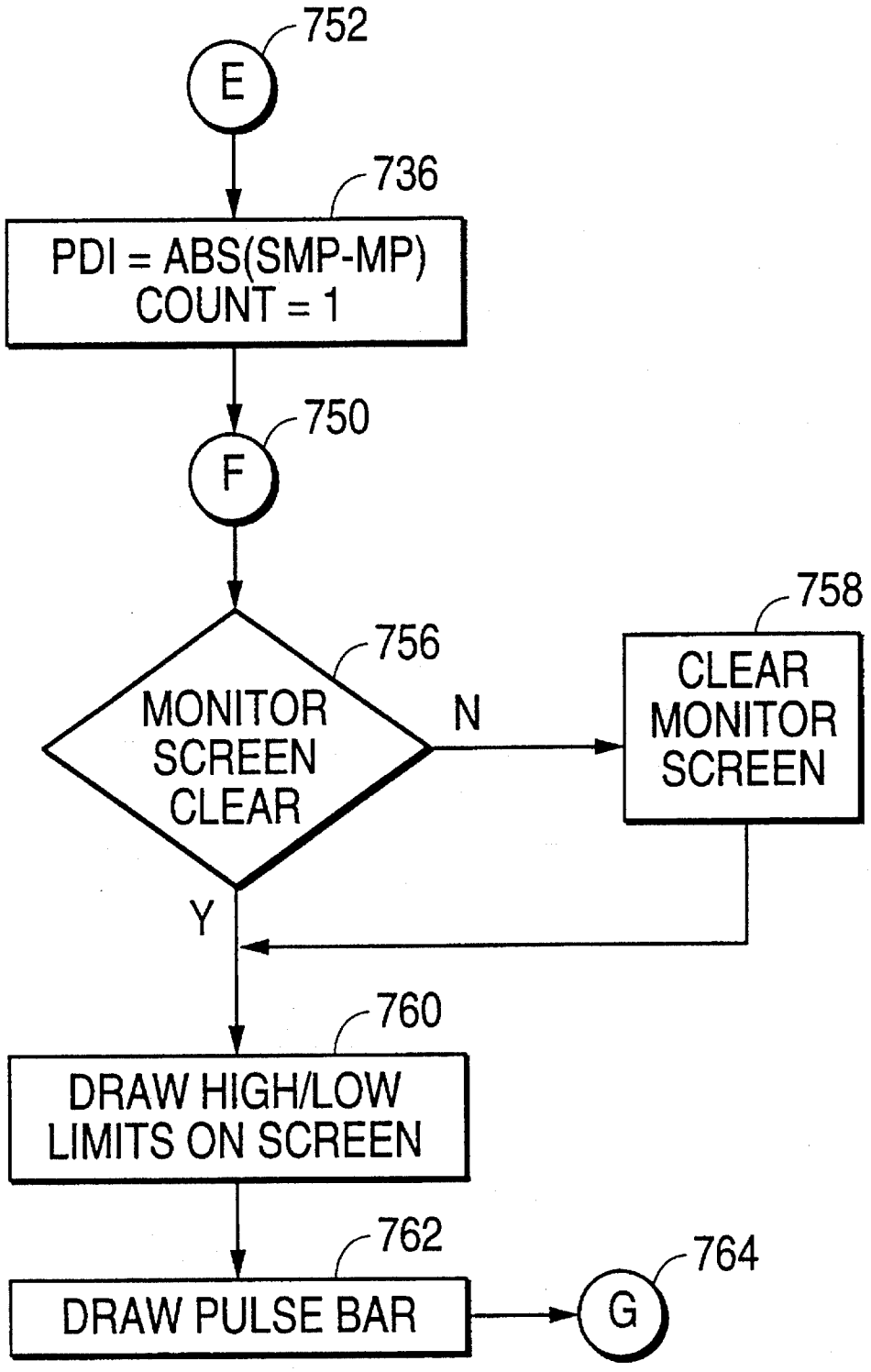
FIG. 5*d* is a continuation of the flow chart of FIG. 5*a;*

Referring now to FIG. 5*d*, operation will continue, as mentioned above, at either terminal point "E" 752 or terminal point "F" 750. At operation rectangle 754 system variables are assigned. At decision point 756, the program will determine if the monitor screen is clear before displaying high and low limits related to a particular target hear rate range and before displaying bars of a bar chart which correspond to pulse rates at reference numerals 758–762.

Figure 5E:
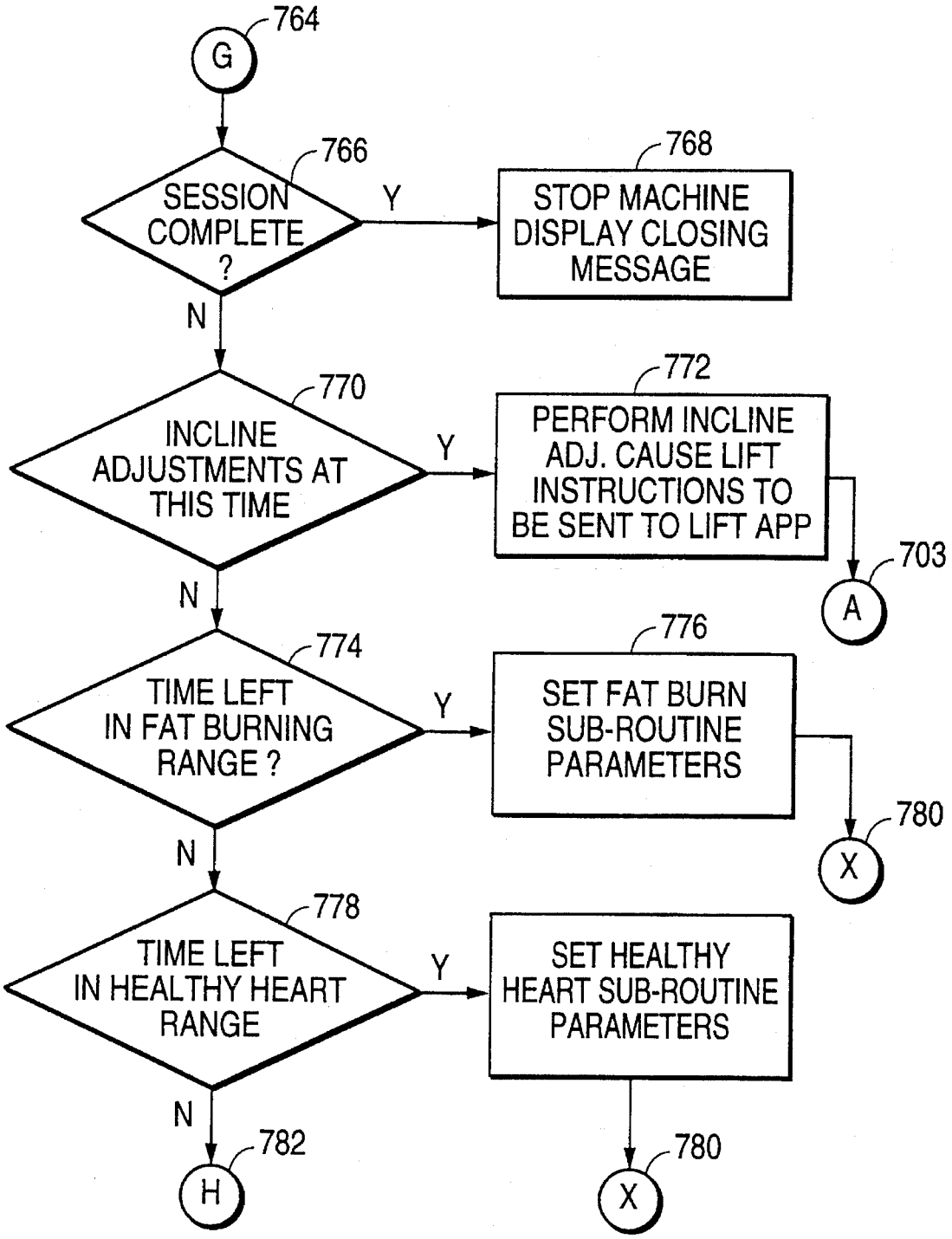
FIG. 5*e* is a continuation of the flow chart of FIG. 5*a;*

Operation continues at terminal point "G" 764 on FIG. 5*e*. The program via microprocessor/microcontroller 420 will inquire as to whether the user's work out session is complete at decision point 766. A work out session can be complete when the user stops, when the specified time has elapsed, etc. If the session is complete the program will stop the exercise device and will display closing messages on the video screen at operation point 768.

If the session is not complete, a series of operations will begin to check various machine and exercise regimen parameters. The program will, first, determine if incline adjustments need to be performed. If such incline adjustments are required, such will be done at operation section 772. After performing incline adjustment, the program will return or loop back to instructions found at terminal point "A" 703.

If no incline adjustments are required, the program will next inquire as to whether there is time remaining in the fat burning range of operation at decision point 774. That is, the program will determine if the user is to remain or enter the fat burning section of his exercise regimen as defined above. If time remains, operation will continue at operation point 776. From operation point 776, operation will continue at terminal point "X" 780. Operation from terminal point "X" 780 will be discussed below. Shown at reference numerals 778–788, are the particular condition states at which a user may be exercising (see above for an explanation of the particular exercise states). That is, the conditions identified at reference numerals 778–788 are implemented in similar design structure and are implemented in regard to the reading from the user's chest belt pulse rate sensor.

Figure 5F:
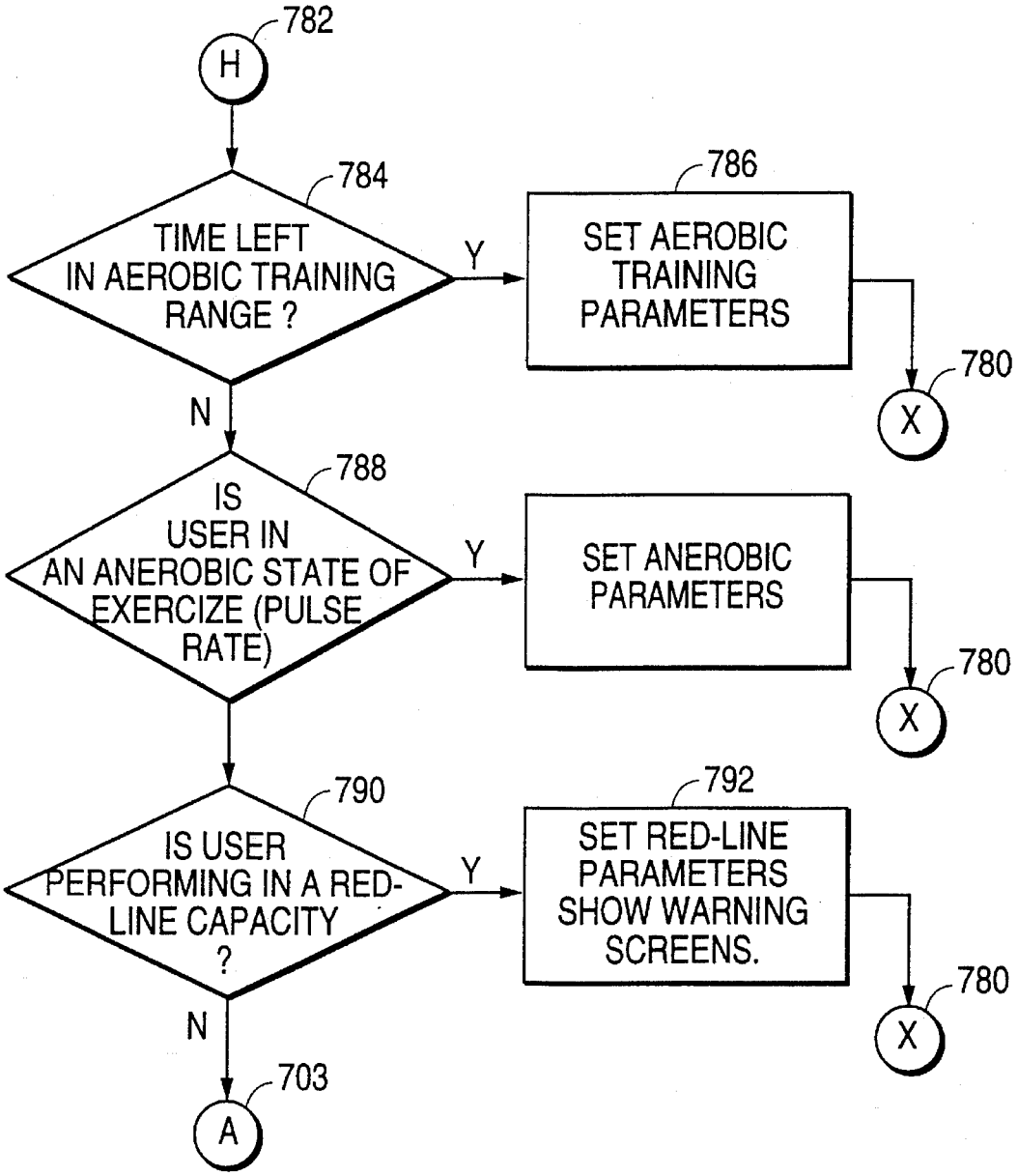
FIG. 5*f* is a continuation of the flow chart of FIG. 5*a;*

After all of the operation states have been passed through, the program will inquire as to whether the user is exercising in a red-line or dangerous heart rate zone at decision point 790 of FIG. 5*f*. If a red-line heart rate zone has been entered, red line parameters will be set and appropriate warning messages will be shown on the video screen at operation point 792. Additionally, the exercise device will be instructed to either speed up or slow down depending on what is required to take user out of his red line condition (i.e. to maintain the user's heart rate in a safe work out capacity).

If a red line heart rate has not been maintained by the user, the program will loop back or return to execution at the start of the program indicated by a return to reference numeral 703 from decision point 790.

Figure 5G:
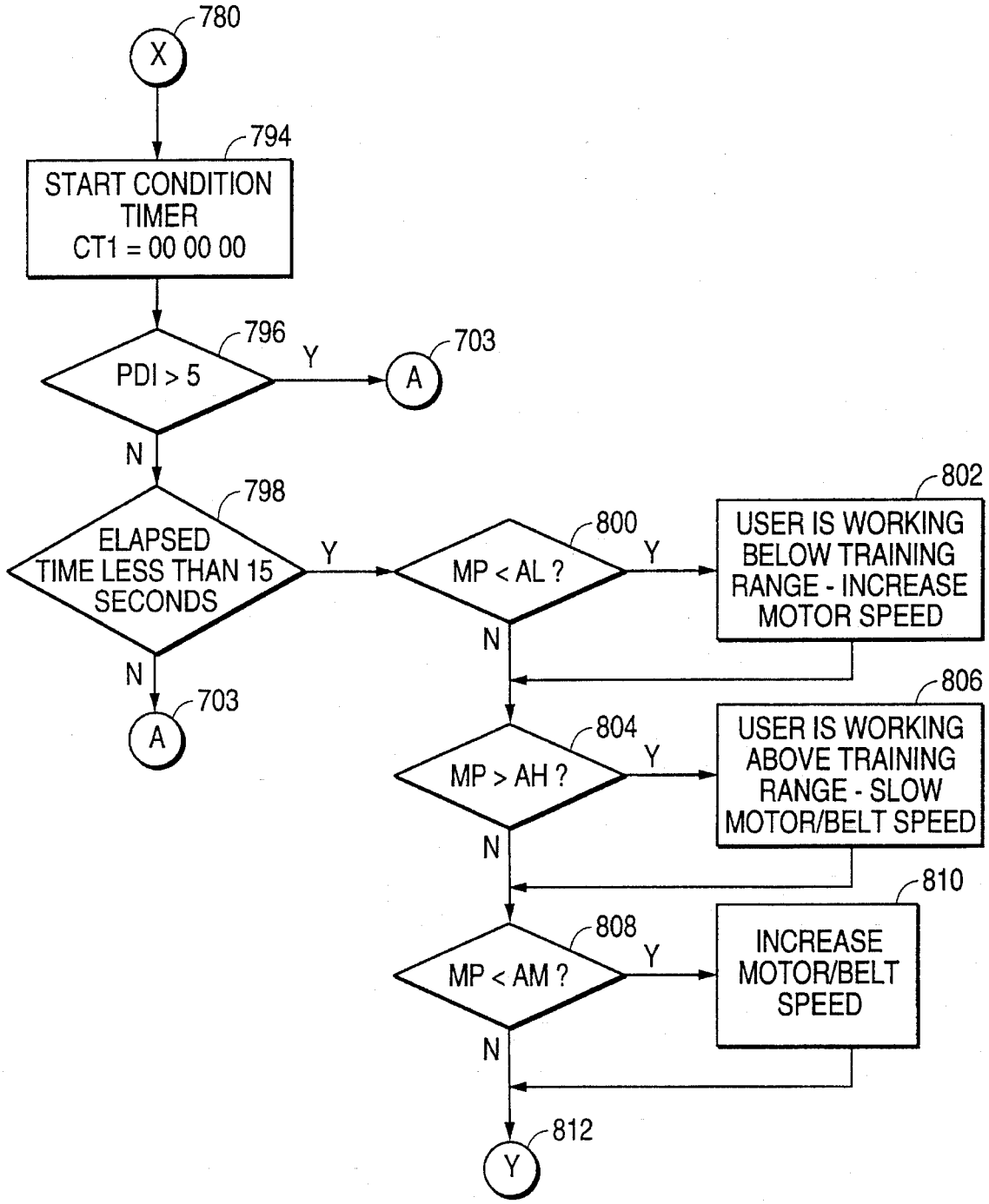
FIG. 5*g* is a continuation of the flow chart of FIG. 5*a;*

Referring now to FIG. 5*g*, terminal point 780 is atop the flow chart. At operation rectangle 794, a condition timer is set to start at 00:00:00. At decision point 796 system variable PDI is checked against the value '5'. In other words, the program is checking whether the user's pulse has leveled out after adjustments were made to the operation of the exercise device (e.g. after speed and/or incline adjustments). If the user's pulse has leveled, operation continues at the beginning of the program by looping back to terminal point "A" 703 in the flow chart (FIG. 5*a*).

If the user's pulse has not leveled, the program will wait at least 15 seconds and inquire if the user user's pulse has leveled within that 15 second period at decision point 798. If the user's pulse does not level within 15 seconds, operation loops back to the beginning of the program as indicated by a branch to terminal point "A" 703.

Figure 5H:
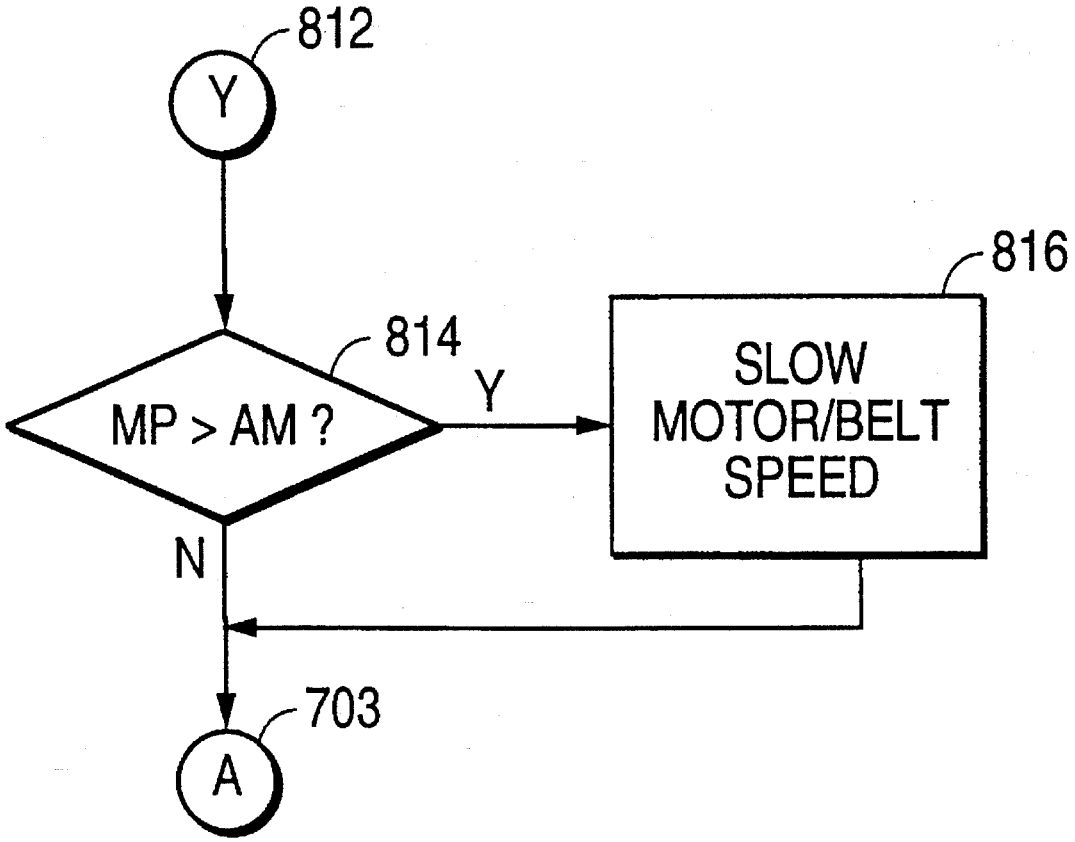
FIG. 5*h* is a continuation of the flow chart of FIG. 5*a*.

If the user's pulse rate does level within 15 seconds, the program causes a series of decision-operation steps to be carried out as indicated at reference numerals 800–816 shown on FIGS. 5*g* and 5*h*. In short, the user's median pulse rate is checked to see whether it is outside a particular training range or whether the user's median pulse rate is at the middle of the user's training range. Depending on the state of the user's median pulse rate, the program will instruct the motor control interface to slow down or speed up the motor accordingly.

Ultimately, the program returns or loops back to the beginning of the program as indicated by the branch to terminal point "A" to thereby repeat execution until otherwise instructed.

Figure 6:
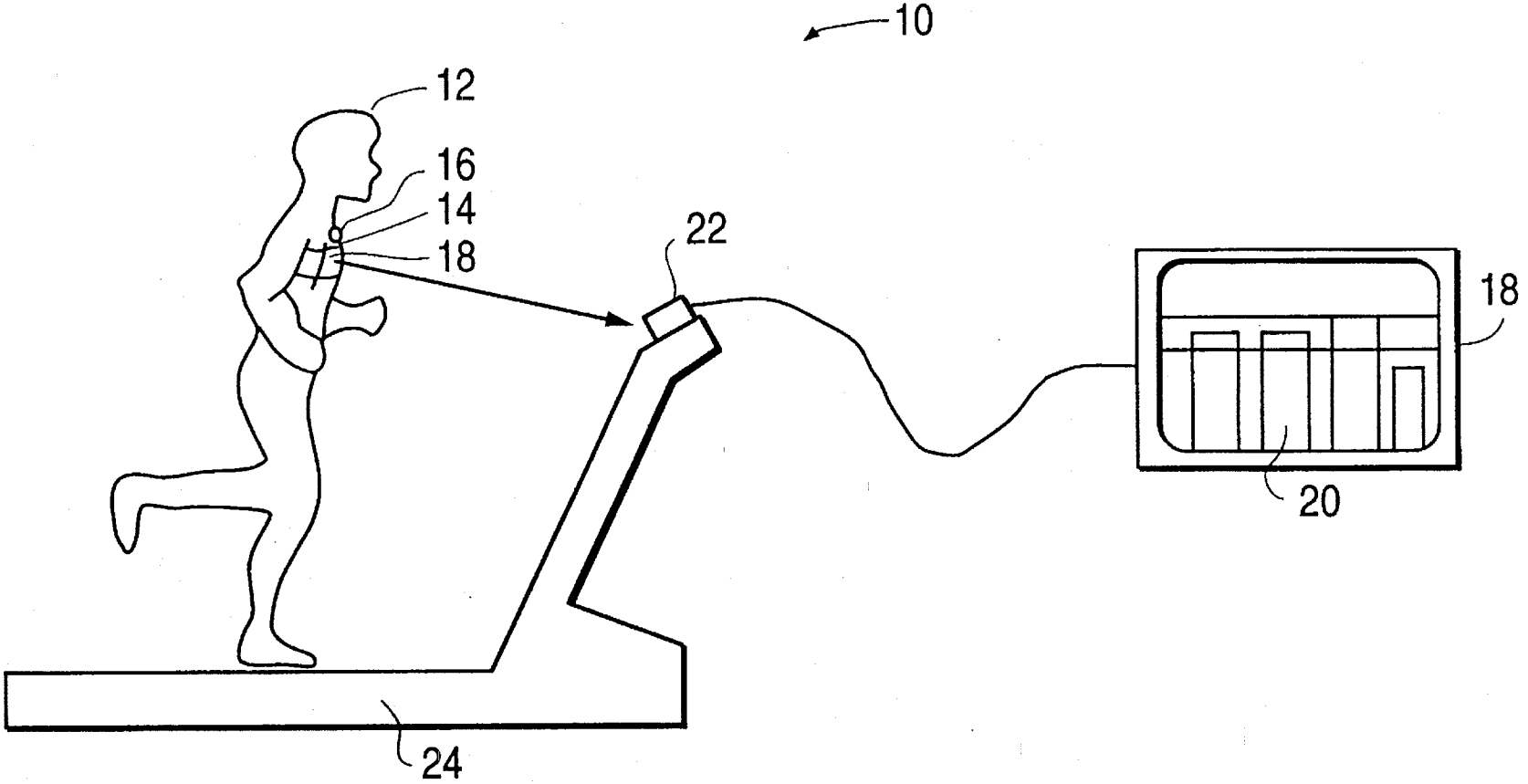
FIG. 6 is a system diagram of another embodiment of present invention in which a user strides on a treadmill exercise device which has signal generation circuitry for generating television signals which may be displayed on a monitor capable of displaying such images.

Referring now to FIG. 6, therein depicted is a system diagram of another embodiment of present invention in which a user strides on a treadmill exercise device which has signal generation circuitry for generating television signals which may be displayed on a monitor capable of displaying such images.

Exercise device 24 of system 10 is equipped with circuitry which can generate television signals and the like for display of user 12's pulse rate on monitor 18. Monitor 18 is shown as a television monitor which may include, but is certainly not limited to, a home television set type device or a projection television set. Moreover, the actual display of user 12's pulse rate may take the form of graphic images as depicted on screen 20. Specifically, the graphic images displayed on screen 20 are of bars on a chart which corresponds the user's pulse rate over time.

The circuitry necessary for implementing system 10 has been described above in regard to the systems depicted in FIGS. 1–4. Moreover, the operation of such a system, with or without motor/resistance control based on user 12's pulse rate, may easily be implemented in view of the above-mentioned discussion of the operation of the systems depicted in FIG. 1–4.

Figure 7:
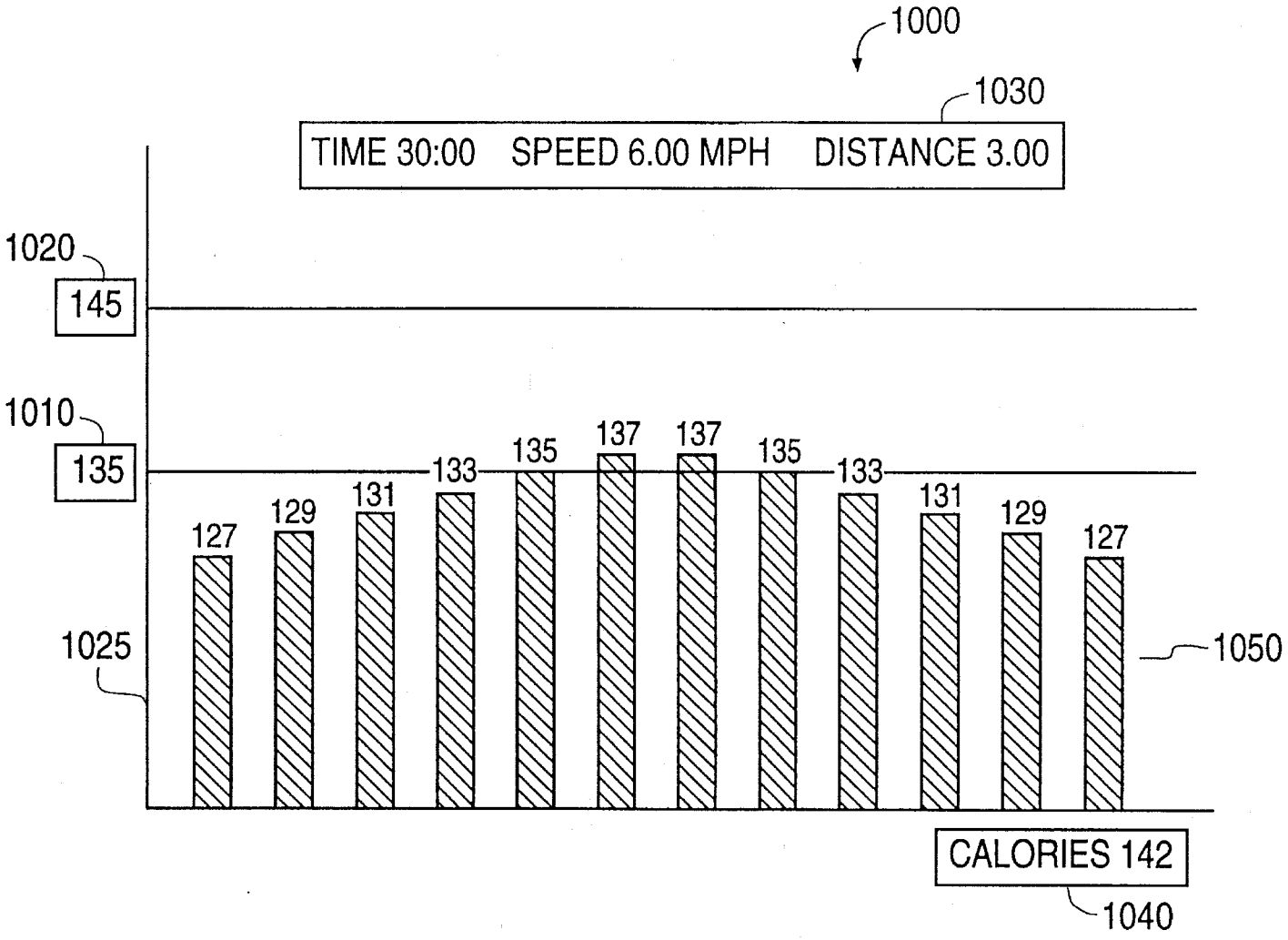
FIG. 7 is a screen image which may appear on a user's television set as he or she engages in a exercise regimen according to the present invention.

Referring now to FIG. 7, therein depicted is a screen image which may appear on a user's television set as he or she engages in a exercise regimen according to the present invention. Screen image 1000 may be displayed on a monitor device according to the teachings found above. Across the top of screen image 1000 is an information bar 1030 which depicts information related to time of work out left or experienced, exercise device or exerciser speed, and distance traveled. Calories consumed during the exerciser's regimen are displayed at calorie indicator 1040 which will be apparent to those skilled in the art.

X–Y quadrant 1025 is depicted screen image 1000 as having X and Y axes. The Y axis represents the heart rate level, while the X axis represents time. With this structure, an exerciser may see his pulse rate as he or she exercises over time. In this particular screen image, the exerciser's target heart range (e.g. fat burning range, aerobic range, or healthy heart range) is depicted by the two horizontal, parallel lines that run across screen image 1000. The high upper limit of the target heart range for the exerciser is depicted as 145 BPM at reference numeral 1020. The lower limit of the target heart rate range for the exerciser is depicted as 135 BPM at reference numeral 1010.

Vertical bars 1050 are shown displayed across screen image 1000. Each bar represents the exerciser's pulse rate at a particular point in time during the exerciser's exercise regimen. Moreover, each bar may indicate an IBI. Most of the bars that appear on screen image 1000 are outside of the exerciser's target heart range. Thus, the systems described above would probably adjust the treadmill's speed and/or incline to cause the exerciser to work harder (i.e. run faster) in order to effectuate a change in the exerciser's pulse rate.

When an exerciser sees the graphic images as they appear in screen image 1000, the exerciser will be motivated to increase his exertion level so that he maintains his heart rate within the target range which will be graphically displayed as bars that are topped in between the two horizontal, parallel lines that run across the screen. The graphic images which display the exerciser's pulse rate help to motivate the exerciser to maintain his effort level in a beneficial range. Moreover, the graphic images reinforce behavior (e.g. exertion level) which will result in the exerciser being able to maintain an exertion level in a particularly desired target heart rate range. These behavioral and motivational features and resulting advantages are not achieved in systems in which a exerciser's pulse rate merely appears as a number on a display.

The implementation of a user-friendly screen image similar to screen image 1000 will be apparent to those skilled in the art. Moreover, programming methodologies to achieve a graphics screen similar to screen image 1000 are well known.

It will be understood that the embodiments described herein are merely exemplary and that a person skilled in the art may make many variations and modifications without departing from the spirit or scope of the invention. All such modifications are intended to be included within the scope of the invention as defined by the appended claims.

What is claimed is:

1. A pulse controlled exercise system comprising:

a base unit having a first transmitter, a first receiver, and a first controller;

a pulse rate sensor for sensing the pulse rate of a user of said pulse controlled exercise system and for transmitting said pulse rate;

an exercise device having a second controller for controlling the speed of said exercise device, a speed sensor for sensing the speed of said exercise device, a second transmitter for transmitting the speed of said exercise device to said base unit and for transmitting the pulse rate of the user of said pulse controlled exercise system to said base unit, and receiving means for receiving instructions from said base unit to modify the speed of said exercise device and for receiving said pulse rate transmitted from the pulse rate sensor, said second transmitter coupled to said receiving means; and a monitor coupled to said base unit for displaying the user's pulse rate, said monitor capable of displaying images formed from television signals;

said first controller being contained within said base unit, and said base unit being remote from said exercise device.

2. The pulse controlled exercise system according to claim 1, wherein said exercise device is a treadmill.

3. The pulse controlled exercise system according to claim 1, wherein radio frequency (RF) transmissions are transmitted from said pulse rate transmitter.

4. The pulse controlled exercise system according to claim 1, wherein infra-red (IR) transmissions are transmitted and received from said first and second transmitters and by said first and second receivers respectively.

5. The pulse controlled exercise system according to claim 1, wherein said pulse rate sensor is a chest belt heart rate monitor.

6. The pulse controlled exercise system according to claim 1, wherein said monitor is a television set.

7. The pulse controlled exercise system according to claim 6, wherein said first transmitter transmits wireless signals including instructions to modify the speed of the exercise device which are received by said receiving means; and wherein said second transmitter transmits wireless signals including the speed of said exercise device and the pulse rate of the user which are received by said first receiver.

8. A pulse controlled exercise system comprising:

a base unit having a first transmitter, a first receiver, and a first controller;

a pulse rate sensor for sensing the pulse rate of a user of said pulse controlled exercise system;

a pulse rate transmitter for transmitting to said base unit the pulse rate of a user of said pulse controlled exercise system;

an exercise device having a second controller for controlling the speed of said exercise device, a speed sensor for sensing the speed of said exercise device, a second transmitter for transmitting the speed of said exercise device to said base unit, and a second receiver for receiving instructions from said base unit to modify the speed of said exercise device; and a monitor coupled to said base unit for displaying the user's pulse rate, said monitor being capable of displaying images formed from television signals;

said first controller being contained within said base unit, and said base unit being remote from said exercise device.

9. The pulse controlled exercise system according to claim 8, wherein said exercise device is a treadmill.

10. The pulse controlled exercise system according to claim 8, wherein infra-red (IR) transmissions are transmitted from said pulse rate transmitter.

11. The pulse controlled exercise system according to claim 8, wherein infra-red (IR) transmissions are transmitted and received from said first and second transmitters and by said first and second receivers respectively.

12. The pulse controlled exercise system according to claim 8, wherein said pulse rate sensor is a chest belt heart rate monitor.

13. The pulse controlled exercise system according to claim 8, wherein said monitor is a television set.

14. The pulse controlled exercise system according to claim 8, wherein said first transmitter transmits wireless signals including instructions to modify the speed of the exercise device which are received by said second receiver; and wherein said second transmitter transmits wireless signals including the speed of said exercise device which are received by said first receiver.

* * * * *